US009428841B2

(12) United States Patent
Arvin et al.

(10) Patent No.: US 9,428,841 B2
(45) Date of Patent: Aug. 30, 2016

(54) APPARATUSES, SYSTEMS AND METHODS THAT ALLOW FOR SELECTIVE REMOVAL OF A SPECIFIC METAL FROM A MULTI-METAL PLATING SOLUTION

(71) Applicant: International Business Machines Corporation, Armonk, NY (US)

(72) Inventors: Charles L. Arvin, Poughkeepsie, NY (US); Stephen G. Dutka, Poughkeepsie, NY (US); Phillip W. Palmatier, Hopewell Junction, NY (US); John R. Pennacchia, Wappingers Falls, NY (US); Freddie Torres, Beacon, NY (US)

(73) Assignee: GLOBALFOUNDRIES INC., Grand Cayman (KY)

( * ) Notice: Subject to any disclaimer, the term of this patent is extended or adjusted under 35 U.S.C. 154(b) by 160 days.

(21) Appl. No.: 14/283,667

(22) Filed: May 21, 2014

(65) Prior Publication Data

US 2015/0337452 A1 Nov. 26, 2015

(51) Int. Cl.

| | |
|---|---|
| ***C25D 21/12*** | (2006.01) |
| ***C25D 21/14*** | (2006.01) |
| ***C25D 21/16*** | (2006.01) |
| ***C25D 21/18*** | (2006.01) |

(52) U.S. Cl.

CPC ..... *C25D 21/14* (2013.01); *C25D 21/12* (2013.01); *C25D 21/16* (2013.01); *C25D 21/18* (2013.01)

(58) Field of Classification Search

CPC ..... C25D 21/12; C25D 21/14; C25D 21/16; C25D 21/18

See application file for complete search history.

(56) References Cited

U.S. PATENT DOCUMENTS 6,592,736 B2 7/2003 Fulton et al.
2010/0276291 A1* 11/2010 Durrer ..... C25D 3/56 205/83

(Continued)

FOREIGN PATENT DOCUMENTS

EP 1840231 A1 10/2007

OTHER PUBLICATIONS

Lou et al. "Electroplating" Encyclopedia of Chemical Processing DOI: 10.1081/E-ECHP-120007747, pp. 1-10, 2006.

*Primary Examiner* — Nicholas A Smith
(74) *Attorney, Agent, or Firm* — Yuanmin Cai, Esq.

(57) ABSTRACT

Disclosed is an apparatus wherein an electric circuit with at least a power source, two electrodes and a plating solution is established. The plating solution comprises a solvent and, dissolved in the solvent, at least a first metal and a second metal. The power source supplies a current to the electric circuit during a plating process. The amount of electric current is above that required to achieve the overpotential for plating the first metal, but below that required to achieve the overpotential for plating the second metal such that only the first metal plates. This apparatus can be implemented, for example, in conjunction with a plating apparatus or an analysis and dosing apparatus of an electrodeposition system. In the case of an analysis and dosing apparatus, additional components further allow for the addition of that specific metal back into the plating solution. Also disclosed herein are associated methods.

11 Claims, 7 Drawing Sheets

(56) References Cited

U.S. PATENT DOCUMENTS

2012/0152751 A1* 6/2012 Baskaran ..... C25D 3/38 205/98
2012/0164379 A1 6/2012 Sherman et al.
2012/0298504 A1 11/2012 Guarnaccia et al.
2012/0325667 A1 12/2012 Arvin et al.
2013/0001198 A1 1/2013 Arvin et al.
2013/0062209 A1 3/2013 Arvin et al.
2013/0334052 A1 12/2013 Chua et al.
2015/0008134 A1* 1/2015 Papapanayiotou .... C25D 21/14 205/101
2015/0284871 A1* 10/2015 Kondo ..... C25D 3/38 205/84
2015/0299891 A1* 10/2015 Buckalew ..... C25D 21/12 205/82

* cited by examiner

APPARATUSES, SYSTEMS AND METHODS THAT ALLOW FOR SELECTIVE REMOVAL OF A SPECIFIC METAL FROM A MULTI-METAL PLATING SOLUTION

BACKGROUND

The present invention relates to electrodeposition and, more particularly, to selective removal of a specific metal from a multi-metal plating solution (i.e., a plating solution containing multiple different metals) and, optionally, addition of that specific metal back into the plating solution.

Generally, electrodeposition (also referred to herein as electroplating) is a process in which one or more different metals are deposited onto workpiece using a plating apparatus (also referred to herein as a plating tool). Specifically, in a plating apparatus during electrodeposition, a first electrode comprising a workpiece (i.e., an object, an article, etc.) to be plated and at least one second electrode are placed into a plating solution (i.e., a plating bath) within a plating container (i.e., a reservoir). For purposes of this disclosure, a plating solution comprises at least a solvent (e.g., water) and a substance (e.g., an acid or base) that is dissolved in the solvent and that provides ionic conductivity. The plating solution can comprise one or more organic additive(s) (also referred to herein as organics), such as complexers, charge carriers, levelers, brighteners and/or wetters, dissolved in the solvent. The plating solution can also comprise one or more metal species dissolved in the solvent (see discussion below regarding replenishment of the metal specie(s)). An electrical circuit is created by connecting a negative terminal of a power supply to the first electrode comprising the workpiece to form a cathode and further connecting a positive terminal of the power supply to the second electrode(s) so as to form anode(s). When the electric circuit is created, electric current flows from the anode(s) to the cathode by means of ion transport through the plating solution and electron transfer at the electrodes occurs such that each of the plating materials, which is/are dissolved in the plating solution as a stabilized metal species (i.e., as metal ions), takes up electrons at the cathode, thereby causing a layer of metal or a layer of a metal alloy (e.g., depending upon whether a single or multiple metal species are used) to deposit on the cathode.

The metal specie(s) in the plating solution can be replenished simultaneously by the anode(s), if/when the anode(s) are soluble (i.e., if/when the anode(s) comprise soluble metal(s)) and the electric current used for plating also causes the soluble metal(s) to dissolve in the plating solution). Additionally or alternatively, the metal specie(s) (e.g., in the form of a metal salt or a metal concentrate, which comprises the metal salt previously dissolved in the same solvent as used in the plating solution) as well as any organic additives can be added directly to the plating solution using a plating solution analysis and dosing apparatus (also referred to herein as a plating solution analysis and dosing tool) that is operably connected to the plating apparatus. Specifically, a pair of tubes (referred to herein as slipstream tubes) can provide a continuous path for the transport of plating solution from the plating apparatus to the plating solution analysis and dosing apparatus and back to the plating apparatus. Within the analysis and dosing apparatus the composition of the plating solution is analyzed and, if necessary, the plating solution can be dosed with metal specie(s) and/or organic additive(s) (i.e., metal specie(s) and/or organic additive(s) are added to the plating solution) to achieve the desired composition. As the desired composition is achieved, the plating solution is transported back to the plating apparatus.

While the metal specie(s) in a plating solution can be selectively replenished using the relatively simple techniques described above, selectively removing one or more metal species from a plating solution can be significantly more difficult and/or costly.

SUMMARY

In view of the foregoing, disclosed herein is an apparatus that allows for selective removal of a specific metal from a multi-metal plating solution (i.e., a plating solution containing multiple different metals). In this apparatus, an electric circuit can be established with at least a power source, two electrodes and a plating solution. The plating solution can comprise a solvent and, dissolved in the solvent, at least a first metal and a second metal. An operating current can be supplied by the power source to the electric circuit in order to perform a plating process. This operating current can specifically be an electric current between a first current amount sufficient to achieve a first activation overpotential for plating of the first metal and a second current amount sufficient to achieve a second activation overpotential for plating of the second metal such that only the first metal plates (i.e., is removed from the plating solution) during the plating process. This apparatus can be implemented as a discrete metal reclamation apparatus or as either a plating apparatus or a plating solution analysis and dosing apparatus of an electrodeposition system. In the case of a plating solution analysis and dosing apparatus, additional components can optionally be included in the apparatus to allow, not only for the selective removal of the specific metal, as described above, but also for the addition of that specific metal back into the plating solution, as needed. Also disclosed herein are associated methods.

More specifically, disclosed herein is an apparatus that allows for selective removal of a specific metal from a multi-metal plating solution (i.e., a plating solution containing multiple different metals). The apparatus can comprise a container containing a plating solution. The plating solution can comprise a solvent and, dissolved in the solvent, at least a first metal and a second metal different from the first metal. The apparatus can further comprise at least a power source having a negative terminal and a positive terminal and a plurality of electrodes, including at least a first electrode in the container and electrically connected to the negative terminal of the power source and a second electrode in the container and electrically connected to the positive terminal of the power source, so as to form an electric circuit.

In operation and, particularly, in order to perform a first metal plating process, the power source can supply an operating current to the electric circuit. This operating current can be an electric current between a first current amount sufficient to achieve a first activation overpotential for plating the first metal on the first electrode and a second current amount sufficient to achieve a second activation overpotential for plating the second metal on the first electrode, wherein the first activation overpotential is less than the second activation overpotential. That is, the operating current supplied by the power source to the electric circuit can be high enough so that the first activation overpotential for plating the first metal is achieved, but not so high that the second activation overpotential for plating the second metal is achieved. Thus, only the first metal (i.e., not the second metal) plates on the first electrode during the first metal plating process.

The apparatus described above can be implemented as a discrete metal reclamation apparatus or as a component of either a plating apparatus or a plating solution analysis and dosing apparatus of an electrodeposition system. In the case of a plating solution analysis and dosing apparatus, additional components can optionally be included in the apparatus to allow, not only for the selective removal of the specific metal, as described above, but also for the addition of that specific metal back into the plating solution, as needed. Thus, for example, also disclosed herein is an electrodeposition system.

This electrodeposition system can comprise a plating apparatus and a plating solution analysis and dosing apparatus. A pair of tubes (referred to herein as slipstream tubes), including a first tube and a second tube, can provide a continuous path for the transport of plating solution from the plating apparatus to the plating solution analysis and dosing apparatus and back to the plating apparatus. The plating solution can comprise a solvent and, dissolved in the solvent, at least a first metal and a second metal different from the first metal.

The plating solution analysis and dosing apparatus can comprise a container. This container can have a first compartment and a second compartment separated from the first compartment by a membrane. The first compartment can contain a plating solution and can comprise an inlet for receiving the plating solution from the plating apparatus via the first tube and an outlet for outputting the plating solution back to the plating apparatus via the second tube. The second compartment can contain an additional solution. This additional solution can comprise the same solvent as the plating solution, but it can be devoid of the metals (i.e., devoid of the first metal and of the second metal).

The plating solution analysis and dosing apparatus can further comprise a plurality of electrodes. These electrodes can include at least a first electrode in the plating solution in the first compartment and a second electrode in the additional solution in the second compartment.

The plating solution analysis and dosing apparatus can further comprise a power source and a polarity-switching unit. The power source can have a negative terminal and a positive terminal. The polarity-switching unit can be electrically connected to the negative terminal, the positive terminal, the first electrode, and the second electrode.

The plating solution analysis and dosing apparatus can further comprise a controller that is operatively connected to the power source and to the polarity-switching unit. This controller can specifically control the power source and the polarity-switching unit so as to selectively cause the performance of any one of the following: a first metal plating process, a first metal de-plating process or establishment and maintenance of an equilibrium potential.

Specifically, in order to establish and maintain an equilibrium potential, the controller can cause the power source to turn off. Thus, during establishment and maintenance of the equilibrium potential, the controller ensures that neither the first electrode, nor the second electrode, is polarized so that neither metal plating, nor metal de-plating occurs in the container.

In order to perform the first metal plating process, the controller can cause the polarity-switching unit to electrically connect the first electrode to the negative terminal and the second electrode to the positive terminal so as to form a first electric circuit. The controller can further cause the power source to turn on so that it supplies a first operating current to the first electric circuit. This first operating current can specifically be an electric current between a first current amount sufficient to achieve a first activation overpotential for plating of the first metal on the first electrode and a second current amount sufficient to achieve a second activation overpotential for plating of the second metal on the first electrode. That is, the controller can ensure that the electric current, which is supplied by the power source to the first electric circuit during the performance of the first metal plating process, is high enough so that the first activation overpotential for plating the first metal is achieved, but not so high that the second activation overpotential for plating the second metal is achieved. Thus, only the first metal (i.e., not the second metal) plates on the first electrode during the first metal plating process.

In order to perform the first metal de-plating process, the controller can cause the polarity-switching unit to electrically connect the first electrode to the positive terminal and the second electrode to the negative terminal so as to form a second electric circuit. The controller can further cause the power source to turn on and to supply a second operating current to the second electric circuit. Additionally, the controller can ensure that the second operating current, which is supplied by the power source to the second electric circuit, is yet another current amount sufficient to achieve a third activation overpotential for de-plating the first metal from the first electrode.

Also disclosed herein is a method that allows for selective removal of a specific metal from a multi-metal plating solution (i.e., a plating solution containing multiple different metals). The method can comprise providing an apparatus. This apparatus can comprise a container containing a plating solution. The plating solution can comprise a solvent and, dissolved in the solvent, a first metal and a second metal different from the first metal. The apparatus can further comprise at least a power source having a negative terminal and a positive terminal and a plurality of electrodes, including at least a first electrode in the container and electrically connected to the negative terminal of the power source and a second electrode in the container and electrically connected to the positive terminal of the power source, so as to form an electric circuit.

The method can further comprise performing a first metal plating process. That is, the method can comprise supplying the electric circuit with an operating current using the power supply to perform such a first metal plating process. In this case, the operating current can specifically be an electric current between a first current amount sufficient to achieve a first activation overpotential for plating the first metal on the first electrode and a second current amount sufficient to achieve a second activation overpotential for plating the second metal on the first electrode, wherein the first activation overpotential is less than the second activation overpotential. That is, the operating current supplied by the power source can be high enough so that the first activation overpotential for plating the first metal is achieved, but not so high that the second activation overpotential for plating the second metal is achieved. Thus, only the first metal (i.e., not the second metal) plates on the first electrode during the first metal plating process.

The method described above can be implemented using a discrete metal reclamation apparatus or either a plating apparatus or a plating solution analysis and dosing apparatus of an electrodeposition system. When the method is implemented using a plating solution analysis and dosing apparatus, additional processes can optionally be performed in order to allow, not only for the selective removal of the specific metal, as described above, but also for the addition of that specific metal back into the plating solution, as needed. Thus, for example, also disclosed herein is an electrodeposition method.

This electrodeposition method can comprise providing an electrodeposition system comprising a plating apparatus and a plating solution analysis and dosing apparatus. In the electrodeposition system, a pair of tubes (referred to herein as slipstream tubes), including a first tube and a second tube, can provide a continuous path for the transport of plating solution from the plating apparatus to the plating solution analysis and dosing apparatus and back to the plating apparatus. The plating solution can comprise a solvent and, dissolved in the solvent, a first metal and a second metal different from the first metal.

The plating solution analysis and dosing apparatus can comprise container. This container can have a first compartment and a second compartment separated from the first compartment by a membrane. The first compartment can contain plating solution received from the plating apparatus. The second compartment can contain an additional solution that comprises the same solvent as the plating solution, but that is devoid of the metal metals (i.e., devoid of the the first metal and the second metal).

The plating solution analysis and dosing apparatus can further comprise a plurality of electrodes. These electrodes can include at least a first electrode in the plating solution in the first compartment and a second electrode in the additional solution in the second compartment.

The plating solution and dosing apparatus can further comprise a power source and a polarity-switching unit. The power source can have a negative terminal and a positive terminal. The polarity-switching unit can be electrically connected to the negative terminal, the positive terminal, the first electrode, and the second electrode.

The method can further comprise selectively performing any one of the following using the plating solution analysis and dosing apparatus: a first metal plating process; a first metal de-plating process or the establishment and maintenance of an equilibrium potential.

Specifically, selectively performing the establishment and maintenance of an equilibrium potential can comprise turning the power source off. Thus, the establishment and maintenance of an equilibrium potential ensures that neither the first electrode, nor the second electrode, is polarized so that neither metal plating, nor metal de-plating occurs in the container.

Selectively performing the first metal plating process can comprise causing the polarity-switching unit to electrically connect the first electrode to the negative terminal and the second electrode to the positive terminal so as to form a first electric circuit and further turning on the power source so as to supply a first operating current to the first electric circuit. This first operating current can specifically be an electric current between a first current amount sufficient to achieve a first activation overpotential for plating of the first metal on the first electrode and a second current amount sufficient to achieve a second activation overpotential for plating of the second metal on the first electrode. That is, the first operating current supplied by the power source to the first electric circuit during the performance of the first metal plating process shall be high enough so that the first activation overpotential for plating the first metal is achieved, but not so high that the second activation overpotential for plating the second metal is achieved. Thus, only the first metal (i.e., not the second metal) plates on the first electrode during the first metal plating process.

Selectively performing the first metal de-plating process can comprise causing the polarity-switching unit to electrically connect the first electrode to the positive terminal and the second electrode to the negative terminal so as to form a second electric circuit and further turning on the power source so as to supply a second operating current to the second electric circuit. The second operating current can be yet another current amount sufficient to achieve a third activation overpotential for de-plating the first metal from the first electrode.

BRIEF DESCRIPTION OF THE SEVERAL VIEWS OF THE DRAWINGS

The embodiments herein will be better understood from the following detailed description with reference to the drawings, which are not necessarily drawn to scale and in which.

DETAILED DESCRIPTION

Figure 1:
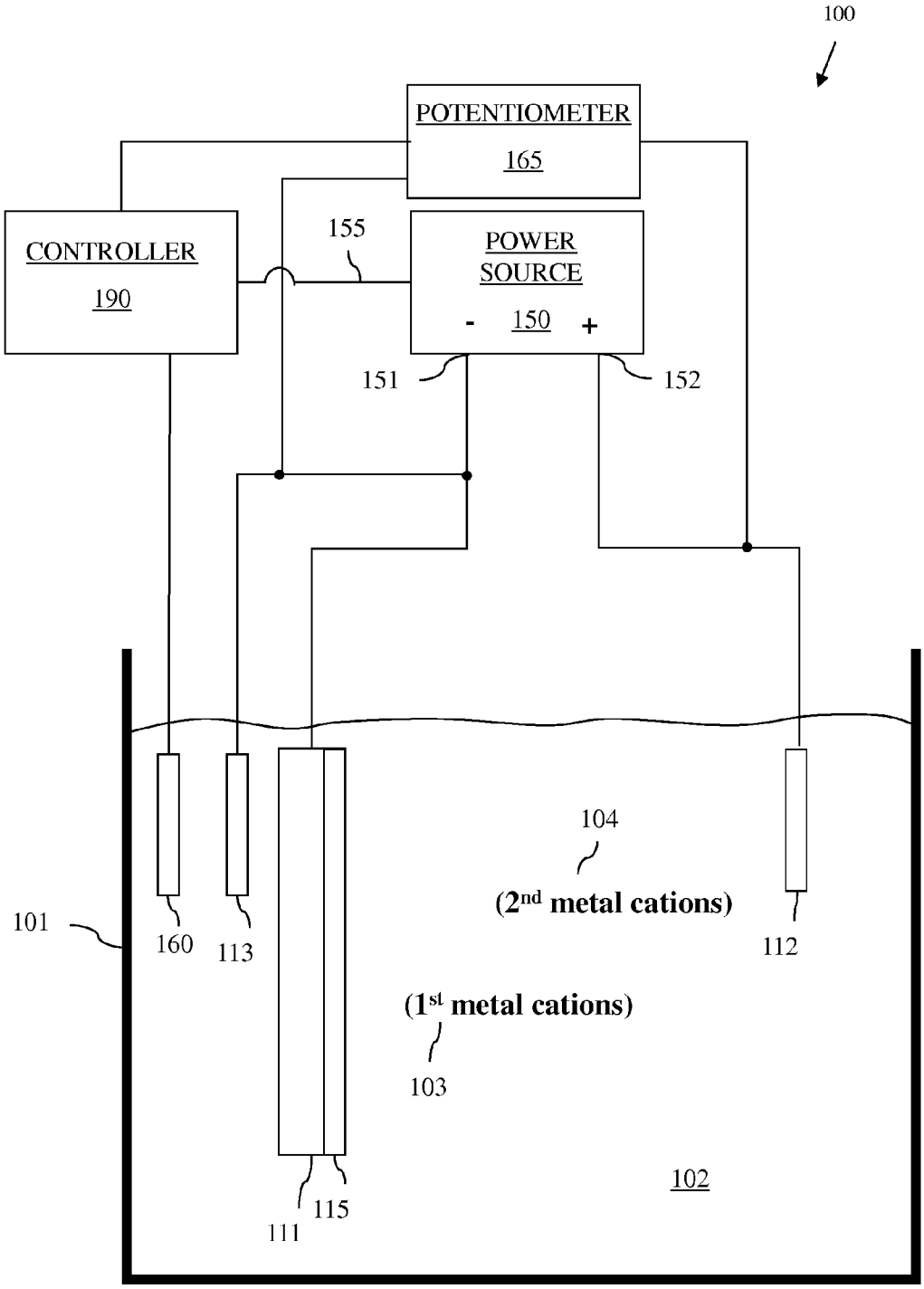
FIG. 1 is a schematic diagram illustrating an apparatus that allows for selective removal of a specific metal from a multi-metal plating solution.

As mentioned above, electrodeposition (also referred to herein as electroplating) is a process in which one or more different metals are deposited onto workpiece using a plating apparatus (also referred to herein as a plating tool). Specifically, in a plating apparatus during electrodeposition, a first electrode comprising a workpiece (i.e., an object, an article, etc.) to be plated and at least one second electrode are placed into a plating solution (i.e., a plating bath) within a plating container (i.e., a reservoir). For purposes of this disclosure, a plating solution comprises at least a solvent (e.g., water) and a substance (e.g., an acid or base) that is dissolved in the solvent and that provides ionic conductivity. The plating solution can comprise one or more organic additive(s) (also referred to herein as organics), such as complexers, charge carriers, levelers, brighteners and/or wetters, dissolved in the solvent. The plating solution can also comprise one or more metal species dissolved in the solvent (see discussion below regarding replenishment of the metal specie(s)). An electrical circuit is created by connecting a negative terminal of a power supply to the first electrode comprising the workpiece to form a cathode and further connecting a positive terminal of the power supply to the second electrode(s) so as to form anode(s). When the electric circuit is created, electric current flows from the anode(s) to the cathode by means of ion transport through the plating solution and electron transfer at the electrodes occurs such that each of the plating materials, which is/are dissolved in the plating solution as a stabilized metal species (i.e., as metal ions), takes up electrons at the cathode, thereby causing a layer of metal or a layer of a metal alloy (e.g., depending upon whether a single or multiple metal species are used) to deposit on the cathode.

The metal specie(s) in the plating solution can be replenished simultaneously by the anode(s), if/when the anode(s) are soluble (i.e., if/when the anode(s) comprise soluble metal(s)) and the electric current used for plating also causes the soluble metal(s) to dissolve in the plating solution). Additionally or alternatively, the metal specie(s) (e.g., in the form of a metal salt or a metal concentrate, which comprises the metal salt previously dissolved in the same solvent as used in the plating solution) as well as any organic additives can be added directly to the plating solution using a plating solution analysis and dosing apparatus (also referred to herein as a plating solution analysis and dosing tool) that is operably connected to the plating apparatus. Specifically, a pair of tubes (referred to herein as slipstream tubes) can provide a continuous path for the transport of plating solution from the plating apparatus to the plating solution analysis and dosing apparatus and back to the plating apparatus. Within the analysis and dosing apparatus the composition of the plating solution is analyzed and, if necessary, the plating solution can be dosed with metal specie(s) and/or organic additive(s) (i.e., metal specie(s) and/or organic additive(s) are added to the plating solution) to achieve the desired composition. As the desired composition is achieved, the plating solution is transported back to the plating apparatus.

While the metal specie(s) in a plating solution can be selectively replenished using the relatively simple techniques described above, removing one or more metal species from a plating solution can be significantly more difficult and/or costly. For example, a tin (Sn)-silver (Ag) plating solution may contain an overabundance of Ag, thereby making a desired SnAg metal alloy composition unachievable. One technique for reducing the concentration of Ag in a SnAg plating solution is to perform an electrodeposition process that forms a SnAg layer on a workpiece, thereby removing the undesired Ag as well as Sn from the plating solution. The removed Sn can subsequently be replenished using, for example, a Sn salt or a Sn concentrate (which comprises the Sn salt previously dissolved in the same solvent as the plating solution). However, the removal and subsequent replenishment of Sn can be costly. In a typical case where a SnAg layer deposits with 97% Sn and 3% Ag, if the electroplating bath contains approximately 140 liters of plating solution, if the cost of Sn is approximately $3.50/gram and if the concentration of Ag has to be reduced by approximately 0.2 g/L (i.e., by a total of approximately 28 g), then the electrodeposition process will simultaneously remove the 28 g of Ag and approximately 905 g of Sn at a cost of approximately $3168. Subsequent replenishment of the Sn in the plating solution adds on the cost of the Sn salt or concentrate. Another technique for reducing the concentration of Ag in a SnAg plating solution is to dilute the plating solution and discard the overflow plating solution or to perform a metal reclamation process on the overflow plating solution. If the overflow plating solution is discarded, the metals contained therein will be lost. Furthermore, current metal reclamation techniques require the use of precipitating agents or other costly chemical separation means to selectively remove different metal species from a plating solution.

In view of the foregoing, disclosed herein is an apparatus that allows for selective removal of a specific metal from a multi-metal plating solution (i.e., a plating solution containing multiple different metals). In this apparatus, an electric circuit can be established with at least a power source, two electrodes and a plating solution. The plating solution can comprise a solvent and, dissolved in the solvent, at least a first metal and a second metal. An operating current can be supplied by the power source to the electric circuit in order to perform a plating process. This operating current can specifically be between a first current amount sufficient to achieve a first activation overpotential for plating of the first metal and a second current amount sufficient to achieve a second activation overpotential for plating of the second metal such that only the first metal plates (i.e., is removed from the plating solution) during the plating process. This apparatus can be implemented as a discrete metal reclamation apparatus or as either a plating apparatus or a plating solution analysis and dosing apparatus of an electrodeposition system. In the case of a plating solution analysis and dosing apparatus, additional components can optionally be included in the apparatus to allow, not only for the selective removal of the specific metal, as described above, but also for the addition of that specific metal back into the plating solution, as needed. Also disclosed herein are associated methods.

More specifically, referring to FIG. 1, disclosed herein is an apparatus 100 that allows for selective removal of a specific metal from a multi-metal plating solution (i.e., a plating solution containing multiple different metals). The apparatus 100 can comprise a container 101 (i.e., a reservoir, a tub, etc.) containing a plating solution 102.

For purposes of this disclosure, the plating solution 102 can comprise at least a solvent (e.g., water) and a substance (e.g., an acid or base) that is dissolved in the solvent and that provides ionic conductivity. The plating solution 102 can comprise one or more organic additive(s) (also referred to herein as organics), such as complexers, charge carriers, levelers, brighteners and/or wetters, dissolved in the solvent. Typically, a plating solution will comprise one or more metal species dissolved in the solvent. As mentioned above, the apparatus 100 disclosed herein is specifically designed for the selective removal of a specific metal from a multi-metal plating solution (i.e., a plating solution containing multiple different metals, including at least a first metal and a second metal different from the first metal). Thus, in this case, the plating solution 102 will contain at least positively charged first ions of a first metal 103 (i.e., first metal cations) and positively charged second ions of a second metal 104 different from the first metal (i.e., second metal cations). The first metal 103 can comprise a noble metal (e.g., gold (Au), platinum (Pt), iridium (Ir), palladium (Pd), osmium (Os), silver (Ag), nickel (Ni), cobalt (Co), rhodium (Rh), ruthenium (Ru), etc.). The second metal 104 can comprise a less noble metal than the first metal 103 or a non-noble metal. Those skilled in the art will recognize that the term "noble" refers to the activation overpotential needed for plating. Thus, the term is relative with some metals being more noble than others (i.e., having a lower activation overpotential than others and, thereby being easier to plate then others). So, in this case, the second metal 104 can have a relatively high activation overpotential for plating in the plating solution 102 as compared to the first metal 103. That is, the first metal 103 can have a first activation overpotential for plating in the plating solution 102 and the second metal 104 can have a second activation overpotential for plating in the plating solution 102, wherein the second activation overpotential is higher than the first activation over potential.

Those skilled in the art will recognize that the term "activation overpotential" refers to the state when the potential difference of the active electrode is sufficient to cause plating of a specific metal on the negatively charged electrode or de-plating from the positively charged electrode. It should be understood that the first and second activation overpotentials will depend upon a variety of factors including, but not limited to, the specific type of first metal and second metal used, the composition of the specific plating solution used, the volume of the plating solution used, and the spacing between the first and second electrodes. These activation overpotentials can further be determined using a systematic approach. That is, plating processes be performed using progressively increasing current amounts and following each plating process the plating solution can be analyzed until the range between the first activation overpotential (wherein the first metal plates so that the first concentration of the first metal is reduced) and the second activation overpotential (wherein both the first metal and the second metal plate so that the first concentration of the first metal and the second concentration of the second metal are both reduced) is determined. The term "equilibrium potential" refers to potential of the electrode relative to a standard hydrogen electrode that is in contact with the plating solution.

For purposes of illustration, the apparatus 100 will be described herein with reference to plating solutions used during the deposition of tin (Sn)-silver (Ag) layer. Typically, such plating solutions are methyl sulfonic acid (MSA)-based. That is, they comprise a solvent (e.g., water) and, dissolved in the water, methyl sulfonic acid (MSA), which provides ionic conductivity. Alternatively, plating solutions that were used for deposition of a SnAg layer can be phosphonate-based plating solutions, pyrophosphate-based plating solutions, or any other suitable plating solutions. In any case, the plating solution 102 can further comprise one or more organic additive(s), such as complexers, charge carriers, levelers, brighteners and/or wetters, dissolved in the water. A plating solution 102 used during deposition of a SnAg layer can also comprise tin ions ($Sn^{2+}$ ions), which have been dissolved in the water from, for example, a tin (Sn) salt or a tin (Sn) concentrate (which was previously dissolved in water or an MSA solution) that was added to the plating solution and/or which have been dissolved in the water, during active plating, from a soluble tin (Sn) anode. A plating solution 102 used during deposition of a SnAg layer can also comprise silver ions (Ag+ ions) dissolved in the water from, for example, a silver (Ag) salt or a silver (Ag) concentrate (which was previously dissolved in water or an MSA solution) that was added to the plating solution. In any case, as discussed above, oftentimes it becomes necessary to separate out or reduce the concentration of the more noble (i.e., lower activation overpotential) Ag+ ions in plating solution used during deposition of a SnAg layer without also reducing the concentration of the less noble (i.e., higher activation overpotential) $Sn^{2+}$ ions in the plating solution. It should be understood that the reference to a plating solution used during deposition of a SnAg layer is not intended to be limiting and, alternatively, the apparatus 100 could be used with any plating solution comprising ions of at least two different metals, having the properties discussed above, and used during deposition of a metal alloy layer.

The apparatus 100 can further comprise at least a power source 150 having a negative terminal 151 and a positive terminal 152 and a plurality of electrodes, including at least a first electrode 111 in the container 101 and electrically connected to the negative terminal 151 of the power source 150 and a second electrode 112 in the container 101 and electrically connected to the positive terminal 152 of the power source 150, so as to form an electric circuit, wherein the first and second electrodes are electrically connected by the plating solution 102. Optionally, the electrodes can include a reference electrode 113, which is also in the container 101 and electrically connected to the negative terminal 151. In the apparatus 100 of FIG. 1, these electrodes 111-113 can all be submerged in the plating solution 102.

The electrodes can all be insoluble electrodes and, preferably, corrosion-resistant electrodes (also referred to herein as inert electrodes). For purposes of this disclosure, a soluble electrode refers to an electrode having an outer metal surface that is exposed to the plating solution and that is soluble in the particular plating solution used. An insoluble electrode refers to an electrode having at least an outer metal surface that is exposed to the plating solution and that is insoluble in (i.e., can not be dissolved in) the particular plating solution used. A corrosion-resistant electrode refers to an electrode having at least an outer metal surface that is exposed to the plating solution, that is insoluble in the particular plating solution used (i.e., that is an insoluble electrode) and that is also resistant to corrosion by the particular plating solution used. With, for example, a MSA-based plating solution used during deposition of a SnAg layer, as described above, an insoluble electrode can refer to, for example, a platinum (Pt) catalyst-coated titanium (Ti) electrode because Ti, when exposed to the MSA-based plating solution is insoluble in a polarized state (i.e., can not be dissolved in) in that MSA-based solution, but may still be subject to corrosion by the plating solution in an unpolarized state; and a corrosion-resistant electrode can refer, for example, to an Alkaline earth metal electrode (e.g., a Vanadium (V) electrode, a niobium (Nb) electrode or a Tantalum (Ta) electrode) or an austenitic-type stainless steel electrode because Alkaline earth metals, such as V, Nb and Ta, as well as austenitic-type stainless steel are not only insoluble in the MSA-based plating solution, but also resistant to corrosion by that MSA-based solution.

Additionally, each electrode and, particularly, at least the first electrode 111 can have a relatively large surface area (e.g., greater than 40 square inches, greater than 100 square inches, etc.) and can comprise a conductive sheet. The conductive sheet can be a conductive solid sheet (e.g., a conductive plate). For example, the conductive sheet can comprise a sheet wafer with a relatively large diameter (e.g., a 200 mm-diameter sheet wafer with a surface area of approximately 48 square inches, 300 mm-diameter sheet wafer with a surface area of approximately 110 square inches, etc.). Alternatively, the conductive sheet can comprise a conductive mesh sheet with similar dimensions, which may provide an even greater surface area for deposition as well as better adhesion.

The apparatus 100 can further comprise at least one agitator 160 that can agitate (i.e., that is adapted to agitate, that is configured to agitate, etc.) the plating solution 102 during a first metal plating process, for example, by rotating or otherwise moving within the plating solution 102 and/or by forcing air into the plating solution 102. Such agitators are well known in the art and, thus, the details thereof are omitted from this specification in order to allow the reader to focus on the salient aspects of the disclosed apparatus.

The apparatus 100 can further comprise a controller 190 that is operably connected to the other components of the apparatus (e.g., to the power source 150 and the agitator(s) 160). This controller 190 can, for example, comprise a computer system such as that described in detail below and illustrated in FIG. 7. This controller 190 can control (i.e., can be adapted to control, can be configured to control, can execute a program of instructions to control, etc.) operation of the apparatus 100 and, particularly, performance by the apparatus 100 of a first metal plating process (e.g., by outputting a power control signal 155 to the power source 150) to decrease a first concentration of the first metal 103 in the plating solution 102 without also decreasing a second concentration of the second metal 104 in the plating solution 102.

Specifically, in order to perform a first metal plating process, the controller 190 can cause the power source 150 to turn on and supply the electric circuit with an operating current. This operating current can specifically be an electric current between a first current amount sufficient to achieve the first activation overpotential for plating the first metal 103 in a plated layer 115 on the first electrode 111 and a second current amount sufficient to achieve the second activation overpotential for plating the second metal 104 on the first electrode. That is, the operating current supplied by the power source 150 to the electric circuit can be high enough so that the first activation overpotential for plating the first metal 103 is achieved, but not so high that the second activation overpotential for plating the second metal is achieved. Thus, only the first metal 103 (i.e., not the second metal 104) plates (see plated layer 115) on the first electrode 111 during the first metal plating process, thereby reducing the first concentration of the first metal 103 but not the second concentration of the second metal 104.

For example, in a container 101 holding approximately 140 L of a MSA-based plating solution 102 used during the deposition of a SnAg layer, as described above, and, submerged within the plating solution 102, a first electrode 111 (in this case a cathode) comprising a wafer that has a 294 mm diameter and a second electrode 112 (in this case an anode) comprising another wafer that has a 300 mm diameter and that is separated from the first electrode 111 by a spacing of approximately 4 inches, a first operating current of approximately 0.2 amps can be supplied by the power source 150 to the electric circuit so that a first activation overpotential for plating Ag is achieved without also achieving the second activation overpotential for plating Sn.

It should be noted that the operating current can be a predetermined electric current amount between the first current amount and the second current amount and the power source 150 can be set so as to constantly supply this predetermined electric current amount (e.g., in a trickle current) to the electric circuit. Alternatively, the apparatus 100 further comprise a potentiometer 165 in communication with the controller 190 and electrically connected to the reference electrode 113 and the second electrode 112. As mentioned above, the reference electrode 113 is electrically connected to the negative terminal 151 of the power source 150 and the second electrode 112 is electrically connected to the positive terminal 152 of the power source 150. In this case, the potentiometer 165 can measure the potential difference between the reference electrode 113 and the second electrode 112 and the controller 190 can selectively adjust the operating current supplied by the power source 150 to the electric circuit so that this measured potential difference remains between the first activation overpotential and the second activation overpotential, thereby ensuring that only the first metal 103 plates on the first electrode 111. Potentiometers are well known in the art and, thus, the details thereof are omitted from this specification in order to allow the reader to focus on the salient aspects of the disclosed apparatus.

The apparatus 100 described above and illustrated in FIG. 1 can be implemented as a discrete metal reclamation apparatus. That is, it can be a separate apparatus used in the recycling of discarded plating solution (i.e., plating solution that has reached the end of its useful life and/or has been discarded for any other reason).

Figure 2:
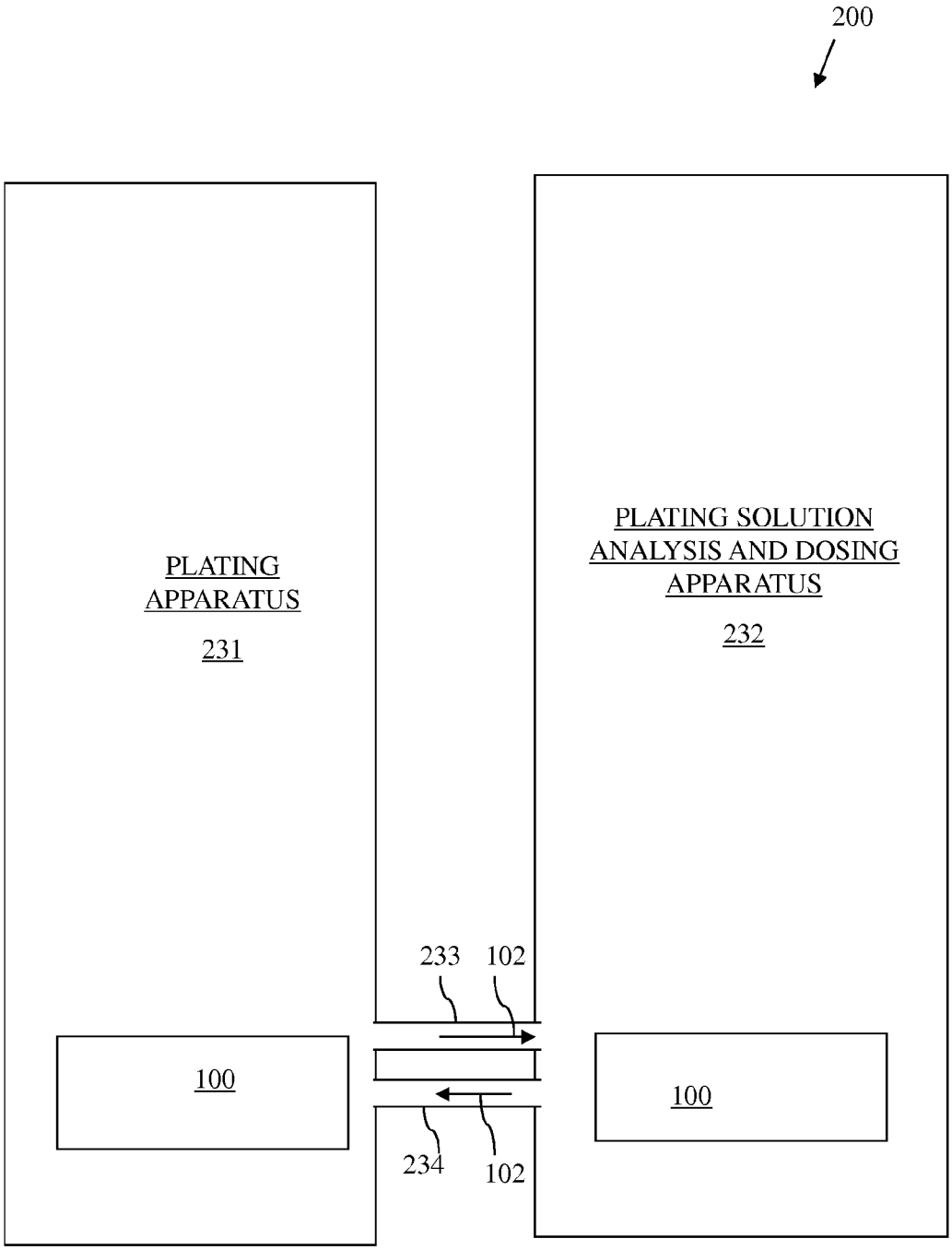
FIG. 2 is a schematic diagram illustrating an electrodeposition system incorporating the apparatus of FIG. 1.

Alternatively, referring to FIG. 2, the apparatus 100 described above and illustrated in FIG. 1 can be implemented as a component of either a plating apparatus 231 (also referred to herein as a plating tool) or a plating solution analysis and dosing apparatus 232 (also referred to herein as a plating solution analysis and dosing apparatus) of an electrodeposition system 200, wherein a pair of tubes (referred to herein as slipstream tubes), including a first tube 233 and a second tube 234, can provide a continuous path for the transport of plating solution 202 from the plating apparatus 231*c* to the plating solution analysis and dosing apparatus 232 for analysis and dosing and back to the plating apparatus 231. Furthermore, when such an apparatus 100 is implemented as a component of a plating solution analysis and dosing apparatus 232, additional components can be included in the apparatus to allow, not only for the selective removal of the specific metal, as described above, but also for the addition of the specific metal back into the plating solution, as needed.

Figure 3:
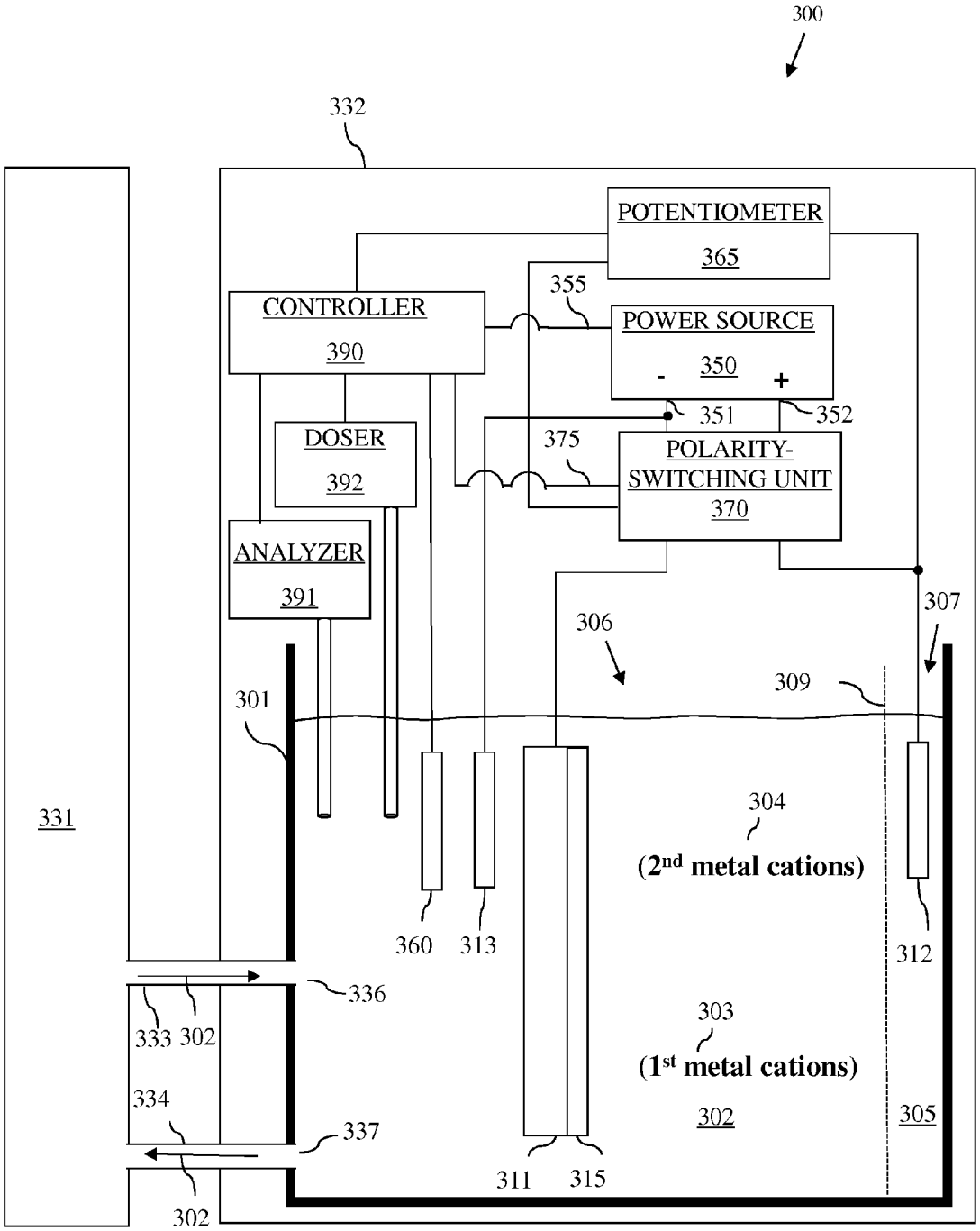
FIG. 3 is a schematic diagram illustrating an electrodeposition system incorporating the apparatus of FIG. 1 as a plating solution analysis and dosing apparatus for selective removal of a specific metal from a multi-metal plating solution and addition of that specific metal back into the multi-metal plating solution.

For example, referring to FIG. 3, also disclosed herein is an electrodeposition system 300 with a plating solution analysis and dosing apparatus 332 configured for selective removal of a specific metal from a multi-metal plating solution 302 as well as for replenishment of that specific metal back into the plating solution 302, as needed. Specifically, this electrodeposition system 300 can comprise a plating apparatus 331 and a plating solution analysis and dosing apparatus 332. A pair of tubes (referred to herein as slipstream tubes), including a first tube 333 and a second tube 334, can provide a continuous path for the transport of plating solution 302 from the plating apparatus 331 to a container 301 (i.e., a reservoir, tub, etc.) in the plating solution analysis and dosing apparatus 332 for processing and, following such processing, back to the plating apparatus 331. Thus, within the electrodeposition system 300, the plating solution 302 can continuously circulate between the plating apparatus 331 and the plating solution analysis and dosing apparatus 332.

As with the plating solution 102 in the apparatus 100 of FIG. 1, the plating solution 302 can comprise at least a solvent (e.g., water) and a substance (e.g., an acid or base) that is dissolved in the solvent and that provides ionic conductivity. The plating solution 302 can comprise one or more organic additive(s) (also referred to herein as organics), such as complexers, charge carriers, levelers, brighteners and/or wetters, dissolved in the solvent. Typically, a plating solution will comprise one or more metal species dissolved in the solvent. As mentioned above, the plating solution analysis and dosing apparatus 332 of the electrodeposition system 300 disclosed herein is specifically designed to allow for the selective removal of a specific metal from a multi-metal plating solution (i.e., a plating solution containing multiple different metals including at least a first metal and a second metal different from the first metal) as well as the addition of that same metal back into the plating solution, as needed. Thus, in this case, the plating solution 302 will contain at least positively charged first ions of a first metal 303 (i.e., first metal cations) and positively charged second ions of a second metal 304 different from the first metal (i.e., second metal cations). The first metal 303 can comprise a noble metal (e.g., gold (Au), platinum (Pt), iridium (Ir), palladium (Pd), osmium (Os), silver (Ag), nickel (Ni), cobalt (Co), rhodium (Rh), ruthenium (Ru), etc.). The second metal 304 can comprise a less noble metal than the first metal 303 or a non-noble metal. Those skilled in the art will recognize that the term "noble" refers to the activation overpotential needed for plating. Thus, the term is relative with some metals being more noble than others (i.e., having a lower activation overpotential than others and, thereby being easier to plate then others). So, in this case, the second metal 304 can have a relatively high activation overpotential for plating in the plating solution 302 as compared to the first metal 303. That is, the first metal 303 can have a first activation overpotential for plating in the plating solution 302 and the second metal 104 can have a second activation overpotential for plating in the plating solution 302, wherein the second activation overpotential is higher than the first activation over potential.

Those skilled in the art will recognize that the term "activation overpotential" refers to the state when the potential difference of the active electrode is sufficient to cause plating of a specific metal on the negatively charged electrode or de-plating from the positively charged electrode. It should be understood that the first and second activation overpotentials will depend upon a variety of factors including, but not limited to, the specific type of first metal and second metal used, the composition of the specific plating solution used, the volume of the plating solution used, and the spacing between the first and second electrodes. These activation overpotentials can further be determined using a systematic approach. That is, plating processes be performed using progressively increasing current amounts and following each plating process the plating solution can be analyzed until the range between the first activation overpotential (wherein the first metal plates so that the first concentration of the first metal is reduced) and the second activation overpotential (wherein both the first metal and the second metal plate so that the first concentration of the first metal and the second concentration of the second metal are both reduced) is determined. The term "equilibrium potential" refers to potential of the electrode relative to a standard hydrogen electrode that is in contact with the plating solution.

For purposes of illustration, the electrodeposition system 300 and, particularly, the plating solution analysis and dosing apparatus 332 of that system 300 will be described herein with reference to plating solutions used by the plating apparatus 331 for the deposition of a tin (Sn)-silver (Ag) layer. Typically, such plating solutions are methyl sulfonic acid (MSA)-based. That is, they comprise a solvent (e.g., water) and, dissolved in the water, methyl sulfonic acid (MSA) that provides ionic conductivity. Alternatively, plating solutions for deposition of a SnAg layer can be phosphonate-based plating solutions, pyrophosphate-based plating solutions or any other suitable plating solution. In any case, the plating solution 302 can further comprise one or more organic additive(s), such as complexers, charge carriers, levelers, brighteners and/or wetters, dissolved in the solvent. The plating solution 302 can also comprise tin ions ($Sn^{2+}$ ions), which have been dissolved in the water from, for example, a tin (Sn) salt or a tin (Sn) concentrate (which was previously dissolved in water or an MSA solution) that was added to the plating solution and/or which have been dissolved in the water, during active plating, from a soluble tin (Sn) anode. The plating solution 102 can also comprise silver ions (Ag+ ions) dissolved in the water from, for example, a silver (Ag) salt or a silver (Ag) concentrate (which was previously dissolved in water or an MSA solution) that was added to the plating solution. In any case, as discussed above, oftentimes it becomes necessary to separate out or reduce the concentration of the more noble (i.e., lower activation overpotential) Ag+ ions in a plating solution used for deposition of a SnAg layer without also reducing the concentration of the less noble (i.e., higher activation overpotential) $Sn^{2+}$ ions in the plating solution. It should be understood that the reference to a plating solution used for deposition of a SnAg layer is not intended to be limiting and, alternatively, the electrodeposition system 300 could be used with any plating solution comprising ions of at least two different metals having the properties discussed above and used for deposition of a metal alloy layer.

As mentioned above, the plating solution analysis and dosing apparatus 332 can comprise a container 301. This container 301 can have a first compartment 306 and a second compartment 307 separated from the first compartment 306 by a membrane 309. The first compartment 306 can contain plating solution 302 and can comprise an inlet 336 for receiving the plating solution 302 from the plating apparatus 331 via the first tube 333 and an outlet 337 for outputting the plating solution 302 back to the plating apparatus 331 following processing via the second tube 334. The second compartment 307 can contain an additional solution 305. This additional solution 305 can comprise the same solvent (e.g., water) as the plating solution 302 with the same substance (i.e., the same acid, such as MSA, or base) dissolved therein for providing ionic conductivity. However, this additional solution 305 can be devoid of the metals (i.e., devoid of the first ions of the first metal 303 and of the second ions of the second metal 304) as well as devoid of any organic additive(s). Furthermore, the membrane 309 separating the first compartment 306 and the second compartment 307 can allow the solvent and electric current to pass, but can be impermeable (i.e., can be adapted to be impermeable, can be configured to be impermeable, etc.) to the metal ions and organic additives so that during processing either to remove or add metal to the plating solution 302 within the first compartment 306, as described in detail below, the additional solution 305 in the second compartment 307 does not become contaminated.

The plating solution analysis and dosing apparatus 332 can further comprise a plurality of electrodes 311-313, a power source 350, a polarity-switching unit 370 and a controller 390.

The electrodes can comprise a first electrode 311 and, optionally, a reference electrode 313 in the plating solution 302 in the first compartment 306 and a second electrode 312 in the additional solution 305 in the second compartment 307. The power source 350 can comprise a negative terminal 351 and a positive terminal 352. The polarity-switching unit 370 can be electrically connected to the first electrode 311, the second electrode 312, the negative terminal 351 of the power source 350 and the positive terminal 352 of the power source 350. The controller 390 can, for example, comprise a computer system such as that described in detail below and illustrated in FIG. 7. The controller 390 can be operably connected to the power source 350 and the polarity-switching unit 370 and, specifically, can control (i.e., can be adapted to control, can be configured to control, can execute a program of instructions stored in memory to control, etc.) the power source 350 and the polarity-switching unit 370 so as to selectively cause, within the container 301 at any given time, the performance of any one of the following: a first metal plating process to decrease a first concentration of the first metal 303 within the plating solution 302 without simultaneously decreasing a second concentration of the second metal 304 within the plating solution 302; a first metal de-plating process to increase the first concentration of the first metal 303 within the plating solution 302; or the establishment and maintenance of an equilibrium potential so that the first concentration of the first metal 303 and the second concentration of the second metal 304 remain constant. It should be understood that, although the controller 390 is described above and illustrated in FIG. 3 as a component of the plating solution analysis and dosing apparatus 332, alternatively, this controller 390 can comprise global controller for controlling operations of the entire electrodeposition system 300, including both the plating solution analysis and dosing apparatus 332 and the plating apparatus 331.

To accomplish this, the electrodes 311-313 can all be insoluble electrodes and, preferably, corrosion-resistant electrodes (also referred to herein as inert electrodes). For purposes of this disclosure, a soluble electrode refers to an electrode having an outer metal surface that is exposed to the plating solution and that is soluble in the particular plating solution used. An insoluble electrode refers to an electrode having at least an outer metal surface that is exposed to the plating solution and that is insoluble in (i.e., can not be dissolved in) the particular plating solution used. A corrosion-resistant electrode refers to an electrode having at least an outer metal surface that is exposed to the plating solution, that is insoluble in the particular plating solution used (i.e., that is an insoluble electrode) and that is also resistant to corrosion by the particular plating solution used. With, for example, a MSA-based plating solution used for deposition of a SnAg layer, as described above, an insoluble electrode can refer to, for example, a platinum (Pt) catalyst-coated titanium (Ti) electrode because Ti, when exposed to the MSA-based plating solution is insoluble in a polarized state (i.e., can not be dissolved in) in that MSA-based solution, but may still be subject to corrosion by the plating solution in an unpolarized state; and a corrosion-resistant electrode can refer, for example, to an Alkaline earth metal electrode (e.g., a Vanadium (V) electrode, a niobium (Nb) electrode or Tantalum (Ta) electrode) or an austenitic-type stainless steel electrode because Alkaline earth metals, such as V, Nb and Ta, as well as austenitic-type stainless steel are not only insoluble in the MSA-based plating solution, but also resistant to corrosion by that MSA-based solution.

Additionally, each electrode and, particularly, at least the first electrode 311 can have a relatively large surface area (e.g., greater than 40 square inches, greater than 100 square inches, etc.) and can comprise a conductive sheet. The conductive sheet can be a conductive solid sheet (e.g., a conductive plate). For example, the conductive sheet can comprise a sheet wafer with a relatively large diameter (e.g., a 200 mm-diameter sheet wafer with a surface area of approximately 48 square inches, 300 mm-diameter sheet wafer with a surface area of approximately 110 square inches, etc.). Alternatively, the conductive sheet can comprise a conductive mesh sheet with similar dimensions, which may provide an even greater surface area for deposition as well as better adhesion.

The controller 390 can output at least one power control signal 355 to the power source 350 and a polarity control signal 375 to the polarity-switching unit 370. The power control signal(s) 355 can cause the power source 350 to turn on or off and can, optionally, provide for the selective adjustment of the output power level from the power source 350. The polarity control signal 375 can cause the polarity-switching unit 370 to selectively switch electrical connections between the negative and positive terminals 351-352 and the first and second electrodes 311-312.

Figure 4:
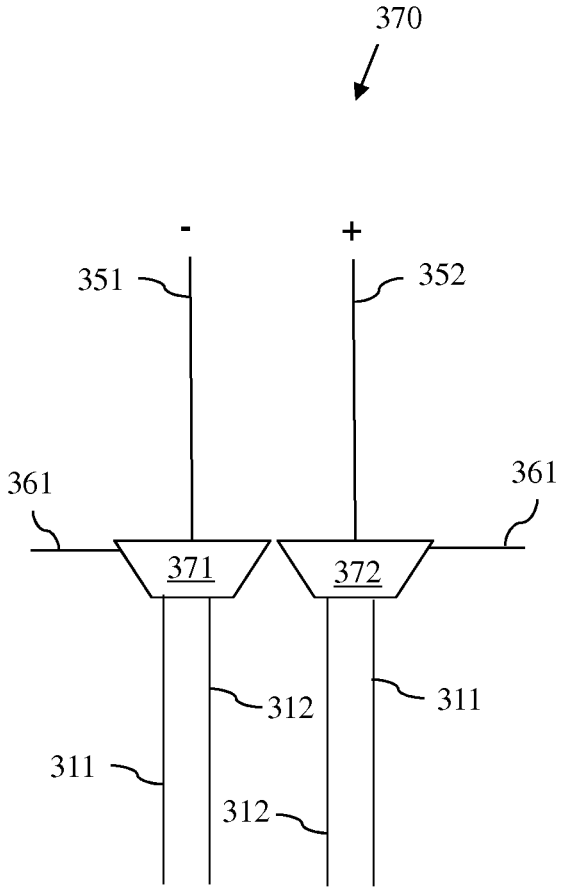
FIG. 4 is a schematic diagram illustrating an exemplary polarity-switching unit that can be incorporated into the electrodeposition system of FIG. 3.

FIG. 4 is a schematic diagram illustrating an exemplary polarity-switching unit 370. This exemplary polarity-switching unit 370 can comprise a pair of multiplexers (i.e., a first multiplexer 371 and a second multiplexer 372). The first multiplexer 371 and the second multiplexer 372 can each receive the polarity control signal 375 from the controller 390. When the polarity control signal 375 has a first value, the first multiplexer 371 can electrically connect the negative terminal 351 to the first electrode 311 and the second multiplexer 372 can electrically connect the positive terminal 352 to the second electrode 312. When the polarity control signal 375 has a second value, the first multiplexer 371 can electrically connect the negative terminal 351 to the second electrode 312 and the second multiplexer 372 can electrically connect the positive terminal 352 to the first electrode 311. It should be noted that the exemplary polarity-switching unit 370 shown in FIG. 4 is offered for illustration purposes and is not intended to be limiting. Any other polarity-switching unit 370 capable of switching the polarities of the first and second electrodes 311-312, as described, could alternatively be used. In any case, by varying the signals 355 and 375 to the power source 350 and polarity-switching unit 370, respectively, the controller 390 can selectively cause the performance of a first metal plating process, the performance of a first metal de-plating process or the maintenance of an equilibrium potential.

Thus, in order to establish and maintain an equilibrium potential, the controller 390 can cause the power source 350 to turn off. Turning off the power source 350 ensures that neither the first electrode 311, nor the second electrode 312, is polarized and, thus, ensures that no metal plating or metal de-plating occurs in the container 301 (i.e., the first concentration of the first metal 303 and the second concentration of the second metal 304 within the plating solution 302 remains constant).

In order to perform the first metal plating process, the controller 390 can cause the polarity-switching unit 370 to electrically connect the first electrode 311 to the negative terminal 351 of the power source 350 and the second electrode 312 to the positive terminal 352 of the power source 350 so as to form a first electric circuit, wherein the first and second electrodes are electrically connected by the plating solution 302 and additional solution 305. The controller 390 can further cause the power source 350 to turn on so as to supply a first operating current to the first electric circuit. This first operating current can specifically be an electric current between a first current amount sufficient to achieve a first activation overpotential for plating of the first metal 303 on the first electrode 311 and a second current amount sufficient to achieve a second activation overpotential for plating of the second metal 304 on the first electrode 311. That is, the controller 390 can ensure that the first operating current supplied by the power source 350 to the first electric circuit (via the polarity-switching unit 370) during the performance of the first metal plating process is high enough so that the first activation overpotential for plating the first metal 303 in a plated layer 315 on the first electrode 311 is achieved, but not so high that the second activation overpotential for plating the second metal 304 is achieved. Thus, only the first metal 303 (i.e., not the second metal 304) plates (see plated layer 315) on the first electrode 311 during the first metal plating process, thereby causing the first concentration of the first metal 303 within the plating solution 302 to decrease and the second concentration of the second metal 304 within the plating solution 302 to remain constant. For example, in a container 301 having a first compartment 306, which holds approximately 140 L of MSA-based plating solution 302 for plating an SnAg layer, as described above and, within the MSA-based plating solution 302, a first electrode 311 comprising a wafer that has a 294 mm diameter and further having a second compartment 307, which holds an equal or lesser amount of an additional solution 305, as described above and, within the additional solution 305, a second electrode 312 comprising another wafer that has a 300 mm diameter and that is separated from the first electrode 311 by a spacing of approximately 4 inches, a first operating current of approximately 0.2 amps can be supplied by the power source 350 to the first electric circuit so that a first activation overpotential for plating Ag is achieved without also achieving the second activation overpotential for plating Sn. Thus, only the Ag (i.e., not Sn) plates on the first electrode 311 during the first metal plating process, thereby causing the first concentration of Ag within the plating solution to decrease and the second concentration of the Sn within the plating solution to remain constant.

In order to perform the first metal de-plating process, the controller 390 can cause the polarity-switching unit 370 to electrically connect the first electrode 311 to the positive terminal 352 of the power source 350 and the second electrode 312 to the negative terminal 351 of the power source 350 so as to form a second electric circuit, wherein the first and second electrodes are electrically connected by the plating solution 302 and additional solution 305. The controller 390 can further cause the power source to turn on so as to supply a second operating current to the second electric circuit. The second operating current can be yet another current amount sufficient to achieve a third activation overpotential for de-plating the first metal 303 from the first electrode 311 and, thereby increasing the first concentration of the first metal 303 within the plating solution 302.

It should be noted that the first operating current can be a predetermined electric current amount between the first current amount and the second current amount and the power source 350 can be set so as to constantly supply this predetermined electric current amount (e.g., in a trickle current). Alternatively, the plating solution analysis and dosing apparatus 332 can further comprise a potentiometer 365 in communication with the controller 390 and electrically connected to the reference electrode 313 and to the second electrode 312. As mentioned above, the reference electrode 313 is in the plating solution 302 and is electrically connected to the negative terminal 351 of the power source 350 and the second electrode 312 is in the additional solution 305 and electrically connected to the positive terminal 352 of the power source 350 during the first metal plating process. In this case, the potentiometer 365 can measure a potential difference between the reference electrode 313 and the second electrode 312 and the controller 390 can selectively adjust the first operating current so that this measured potential difference remains between the first activation overpotential and the second activation overpotential to ensure that only the first metal 303 plates onto the first electrode 311 during the first metal plating process. Potentiometers are well known in the art and, thus, the details thereof are omitted from this specification in order to allow the reader to focus on the salient aspects of the disclosed electrodeposition system.

The plating solution analysis and dosing apparatus 332 can further comprise at least one agitator 360 that can agitate (i.e., that is adapted to agitate, that is configured to agitate, etc.) the solutions 302 and 305 during the first metal plating process as well as during the first metal de-plating process. Such agitator(s) can operate, for example, by rotating or otherwise moving within the solutions 302 and 305 and/or by forcing air into the solutions 302 and 305. Such agitators are well known in the art and, thus, the details thereof are omitted from this specification in order to allow the reader to focus on the salient aspects of the disclosed apparatus.

The plating solution analysis and dosing apparatus 332 can further comprise a plating solution analyzer 391 in communication with the controller 390. The plating solution analyzer 391 can determine (i.e., can be adapted to determine, can be configured to determined, etc.) the composition of the plating solution 302 in the first compartment 306 and, particularly, can comprise one or more devices that can determine the concentration of one or more of the components of the plating solution 302 (e.g., the concentration of the first metal 303, the concentration of the second metal 304, and/or the concentration of any organic additives). Devices capable of measuring chemical compositions of solutions are well known in the art and, thus, the details thereof are omitted from the specification in order to allow the reader to focus on the salient aspects of the disclosed electrodeposition system. In any case, once the composition is determined, the controller 390 can, based on that composition, selectively cause the performance of the first metal plating process (e.g., if the concentration of the first metal 303 in the plating solution 302 should be reduced), the performance of the first metal de-plating process (i.e., if the concentration of the first metal 303 in the plating solution 302 should be increased) or the establishment and maintenance of the equilibrium potential (e.g., if the correct ratio of the first metal 303 to the second metal 304 has been reached), as described above. That is, the controller 390 can compare (i.e., can be adapted to compare, can be configured to compare, can execute a program of instructions that compares, etc.) the actual composition of the plating solution 302, as determined by the plating solution analyzer 391, to a desired composition (e.g., entered by a user, stored in a memory of the controller, etc.) and, if necessary, can initiate the performance of the first metal plating process, can initiate the performance of the first metal de-plating processes or can establish (i.e., bring about) and maintain the equilibrium potential. For example, the plating solution analyzer 391 can comprise a coulometric measurement device that can measure the amount of the first metal 303 dissolved into the plating solution 302 during a first metal de-plating process and, when the desired amount has been dissolved as measured by the coulometric measurement device, the controller 390 stop the first metal de-plating process and establish and maintain the equilibrium potential.

Additionally, the plating solution analysis and dosing apparatus 332 can comprise a doser 392 (i.e., a dosing device) in communication with the controller 390. The doser 392 can add (i.e., can be adapted to determine, can be configured to determined, etc.) at least one additive to the plating solution 302. The additive can comprise, for example, a salt or concentrate of the second metal (e.g., if the concentration of the second metal 304 in the plating solution 302 should be increased) or one or more organic additive(s) (e.g., if the concentration of any of the organic additives need to be increased), as necessary. The type of additive, amount of additive, and rate of addition can be predetermined by a user and programmed into the doser 392 for a given process. Alternatively, the type of additive, amount of additive, and rate of addition can be calculated by the controller 390 based on a comparison of the actual composition of the plating solution 302, as determined by plating solution analyzer 391, to a desired composition (e.g., as entered by a user, stored in a memory of the controller, etc.). For example, during a first metal de-plating process, as the first metal 303 is dissolved back into the plating solution 302 over a given amount of time, the doser 392 can add a complexer into the plating solution 302 and can further meter the amount of complexer added over time so that the ratio of the first metal 303 to complexer within the plating solution 302 remains essentially constant. Those skilled in the art will recognize that any additive added to the plating solution 302 by the doser 392 should be metered in over time and the rate of addition should take into consideration the flow rate out the outlet 337 and through the tube 334 into the plating apparatus 331 in order to avoid plating solution destabilization within the plating apparatus 331. Dosers capable of adding additives to a solution and capable of doing so in a metered fashion are well known in the art and, thus, the details thereof are omitted from this specification in order to allow the reader to focus on the salient aspects of the disclosed electrodeposition system.

In the electrodeposition system 300 described above, the plating analysis and dosing apparatus 332 can operate simultaneously with the plating apparatus 331. That is, the plating solution 302 can continuously circulate through the slipstream tube 333 and inlet 336 into the first compartment 306 of the container 301 and back through the outlet 337 and the slipstream tube 334 into the plating apparatus 331. While in the first compartment 306 of the container 301 of the plating solution analysis and dosing apparatus 332, the plating solution 302 can be processed to adjust its composition, as discussed in detail above. That is, the plating solution 302 can be processed to increase, decrease or maintain the concentration of the first metal 303 contained therein as well as to increase the concentration of other additives, such as a salt or concentrate of the second metal 304 and/or any organic additives, as necessary. While in the plating apparatus 331, this same plating solution 302 can be used to plate a workpiece (not shown). By providing continuous analysis of and adjustments to the composition of the plating solution 302 simultaneous with the plating of a workpiece, the electrodeposition system 300 disclosed herein can vary the composition of the resulting plated layer on the workpiece as it is being plated and, thereby provides for greater plating control even at relatively high deposition rates. That is, by providing continuous analysis of and adjustments to the composition of the plating solution simultaneous with the plating of a workpiece, the electrodeposition system 300 disclosed herein allows the plating apparatus 331 to plate a metal alloy (e.g., SnAg) on a workpiece at a relatively high deposition rate and to do so such that the metal alloy deposits with selectively different ratios of a first metal 303 to a second metal 304 (e.g., selectively higher or lower Ag contents) throughout that plating process.

Figure 5:
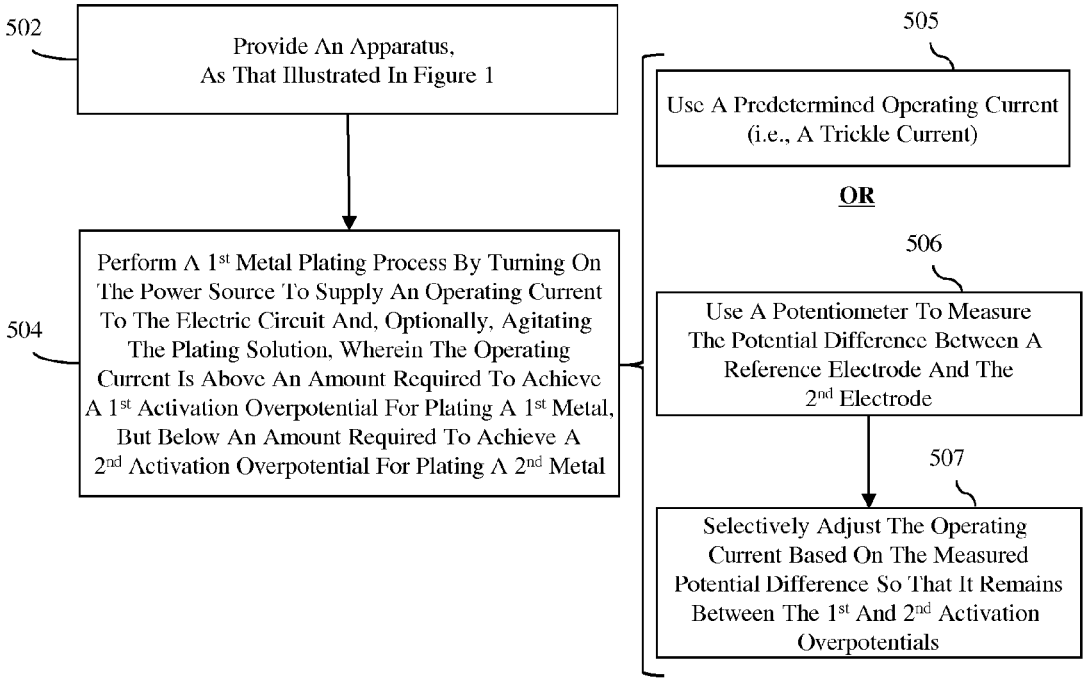
FIG. 5 is a flow diagram illustrating a method for selective removal of a specific metal from a multi-metal plating solution.

Referring to the flow diagram of FIG. 5 in combination with the apparatus 100 of FIG. 1, also disclosed herein is a method for selective removal of a specific metal from a multi-metal plating solution (i.e., a plating solution containing multiple different metals).

Specifically, the method can comprise providing an apparatus 100, such as that described in detail above and illustrated in FIG. 1 (502).

As described in detail above with regard to the structures disclosed herein, this apparatus 100 can comprise a container 101 (i.e., a reservoir, a tub, etc.) containing a plating solution 102. The plating solution 102 can comprise at least a solvent (e.g., water) and a substance (e.g., an acid or base) that is dissolved in the solvent and that provides ionic conductivity. The plating solution 102 can comprise one or more organic additive(s) (also referred to herein as organics), such as complexers, charge carriers, levelers, brighteners and/or wetters, dissolved in the solvent. The plating solution 102 can further contain multiple different metals including at least a first metal and a second metal that is different from the first metal. That is, the plating solution 102 can comprise at least positively charged first ions of a first metal 103 (i.e., first metal cations) and positively charged second ions of a second metal 104 different from the first metal (i.e., second metal cations). The first metal 103 can comprise a noble metal (e.g., gold (Au), platinum (Pt), iridium (Ir), palladium (Pd), osmium (Os), silver (Ag), nickel (Ni), cobalt (Co), rhodium (Rh), ruthenium (Ru), etc.). The second metal 104 can comprise a less noble metal than the first metal 103 or a non-noble metal. Those skilled in the art will recognize that the term "noble" refers to the activation overpotential needed for plating. Thus, the term is relative with some metals being more noble than others (i.e., having a lower activation overpotential than others and, thereby being easier to plate then others). So, in this case, the second metal 104 can have a relatively high activation overpotential for plating in the plating solution 102 as compared to the first metal 103. That is, the first metal 103 can have a first activation overpotential for plating in the plating solution 102 and the second metal 104 can have a second activation overpotential for plating in the plating solution 102, wherein the second activation overpotential is higher than the first activation over potential.

Those skilled in the art will recognize that the term "activation overpotential" refers to the state when the potential difference of the active electrode is sufficient to cause plating of a specific metal on the negatively charged electrode or de-plating from the positively charged electrode. It should be understood that the first and second activation overpotentials will depend upon a variety of factors including, but not limited to, the specific type of first metal and second metal used, the composition of the specific plating solution used, the volume of the plating solution used, and the spacing between the first and second electrodes. These activation overpotentials can further be determined using a systematic approach. That is, plating processes be performed using progressively increasing current amounts and following each plating process the plating solution can be analyzed until the range between the first activation overpotential (wherein the first metal plates so that the first concentration of the first metal is reduced) and the second activation overpotential (wherein both the first metal and the second metal plate so that the first concentration of the first metal and the second concentration of the second metal are both reduced) is determined. The term "equilibrium potential" refers to potential of the electrode relative to a standard hydrogen electrode that is in contact with the plating solution. For example, the plating solution can comprise a plating solution used during deposition of a tin (Sn)-silver (Ag) layer, as described in detail above, comprising both Ag+ ions, which are of a noble metal, and $Sn^{2+}$ ions, which are of a non-noble metal and which have a higher overpotential in the plating solution than the Ag+ ions. It should be understood that the reference to plating solution used during deposition of an SnAg layer is not intended to be limiting and, alternatively, the method could be performed using any plating solution comprising ions of at least two different metals, having the properties discussed above, and used for deposition of a metal alloy layer.

The apparatus 100 can further comprise at least a power source 150 having a negative terminal 151 and a positive terminal 152 and a plurality of electrodes, including at least a first electrode 111 in the container 101 and electrically connected to the negative terminal 151 of the power source 150 and a second electrode 112 in the container 101 and electrically connected to the positive terminal 152 of the power source 150, so as to form an electric circuit, wherein the first and second electrodes are electrically connected by the plating solution 102. Optionally, the electrodes can include a reference electrode 113, which is also in the container 101 and electrically connected to the negative terminal 151. In the apparatus 100 of FIG. 1, these electrodes 111-113 can all be submerged in the plating solution 102 and can all be insoluble electrodes and, preferably, corrosion-resistant electrodes (also referred to herein as inert electrodes). With, for example, a MSA-based plating solution used during deposition of an SnAg layer, as described above, an insoluble electrode can refer to, for example, a platinum (Pt) catalyst-coated titanium (Ti) electrode because Ti, when exposed to the MSA-based plating solution is insoluble in a polarized state (i.e., can not be dissolved in) in that MSA-based solution, but may still be subject to corrosion by the plating solution in an unpolarized state; and a corrosion-resistant electrode can refer, for example, to an Alkaline earth metal electrode (e.g., a Vanadium (V) electrode, a niobium (Nb) electrode or Tantalum (Ta) electrode) or an austenitic-type stainless steel electrode because Alkaline earth metals, such as V, Nb and Ta, as well as austenitic-type stainless steel are not only insoluble in the MSA-based plating solution, but also resistant to corrosion by that MSA-based solution. Additionally, each electrode and, particularly, at least the first electrode 111 can have a relatively large surface area (e.g., greater than 40 square inches, greater than 100 square inches, etc.) and can comprise a conductive sheet. The conductive sheet can be a conductive solid sheet (e.g., a conductive plate). For example, the conductive sheet can comprise a sheet wafer with a relatively large diameter (e.g., a 200 mm-diameter sheet wafer with a surface area of approximately 48 square inches, 300 mm-diameter sheet wafer with a surface area of approximately 110 square inches, etc.). Alternatively, the conductive sheet can comprise a conductive mesh sheet with similar dimensions, which may provide an even greater surface area for deposition as well as better adhesion.

The method can further comprise performing a first metal plating process using the apparatus 100 to decrease a first concentration of the first metal 103 in the plating solution 102 without simultaneously decreasing a second concentration of the second metal 104 within the plating solution 102 (504). Performance of the first metal plating process 504 can comprise turning on the power source 150 so as to supply the electric circuit with an operating current and, optionally, agitating the plating solution 102 (e.g., using one or more agitator(s) 160). The operating current used during this first metal plating process can specifically be an electric current between a first current amount sufficient to achieve the first activation overpotential for plating the first metal 103 in a plated layer 115 on the first electrode 111 and a second current amount sufficient to achieve the second activation overpotential for plating the second metal 104 on the first electrode. That is, the operating current supplied by the power source 150 to the electric circuit can be high enough so that the first activation overpotential for plating the first metal 103 is achieved, but not so high that the second activation overpotential for plating the second metal is achieved. Thus, only the first metal 103 (i.e., not the second metal 104) plates (see plated layer 115) on the first electrode 111 during the first metal plating process, thereby ensuring that only the first concentration of the first metal 103 and not a second concentration of the second metal 104 is reduced within the plating solution 102. For example, in a container 101 holding approximately 140 L of MSA-based plating solution 102 used during the deposition of an SnAg layer, as described above and, within the plating solution 102, a first electrode 111 (in this case a cathode) comprising a wafer that has a 294 mm diameter and a second electrode 112 (in this case an anode) comprising another wafer that has a 300 mm diameter and that is separated from the first electrode 111 by a spacing of approximately 4 inches, a first operating current of approximately 0.2 amps can be supplied by the power source 150 to the electric circuit so that a first activation overpotential for plating Ag is achieved without also achieving the second activation overpotential for plating Sn. Thus, only the Ag (i.e., not Sn) plates on the first electrode 111 during the first metal plating process, thereby causing the first concentration of Ag within the plating solution to decrease and the second concentration of the Sn within the plating solution to remain constant.

It should be noted that, during the first metal plating process 504, the operating current used can be a predetermined electric current amount between the first current amount and the second current amount and the power source 150 can be set so as to constantly supply this predetermined current amount (e.g., in a trickle current) to the electric circuit (505). Alternatively, during the first metal plating process 504, a potential difference between a reference electrode 113, which is in the plating solution 102 and electrically connected to the negative terminal 151 of the power source 150, and the second electrode 112 can be measured (e.g., using a potentiometer 165) (506). In this case, the operating current supplied by the power source 150 to the electric circuit can be selectively adjusted so that this measured potential difference remains between the first activation overpotential and the second activation overpotential, thereby ensuring that only the first metal 103 plates on the first electrode 111 (507).

The method described above and illustrated in the flow diagram of FIG. 5 can be implemented using a discrete metal reclamation apparatus or in either a plating apparatus or a plating solution analysis and dosing apparatus of an electrodeposition system. When the method is implemented using a plating solution analysis and dosing apparatus, additional processes can optionally be performed in order to allow, not only for the selective removal of the specific metal, as described above, but also for the addition of that specific metal back into the plating solution, as needed.

Figure 6:
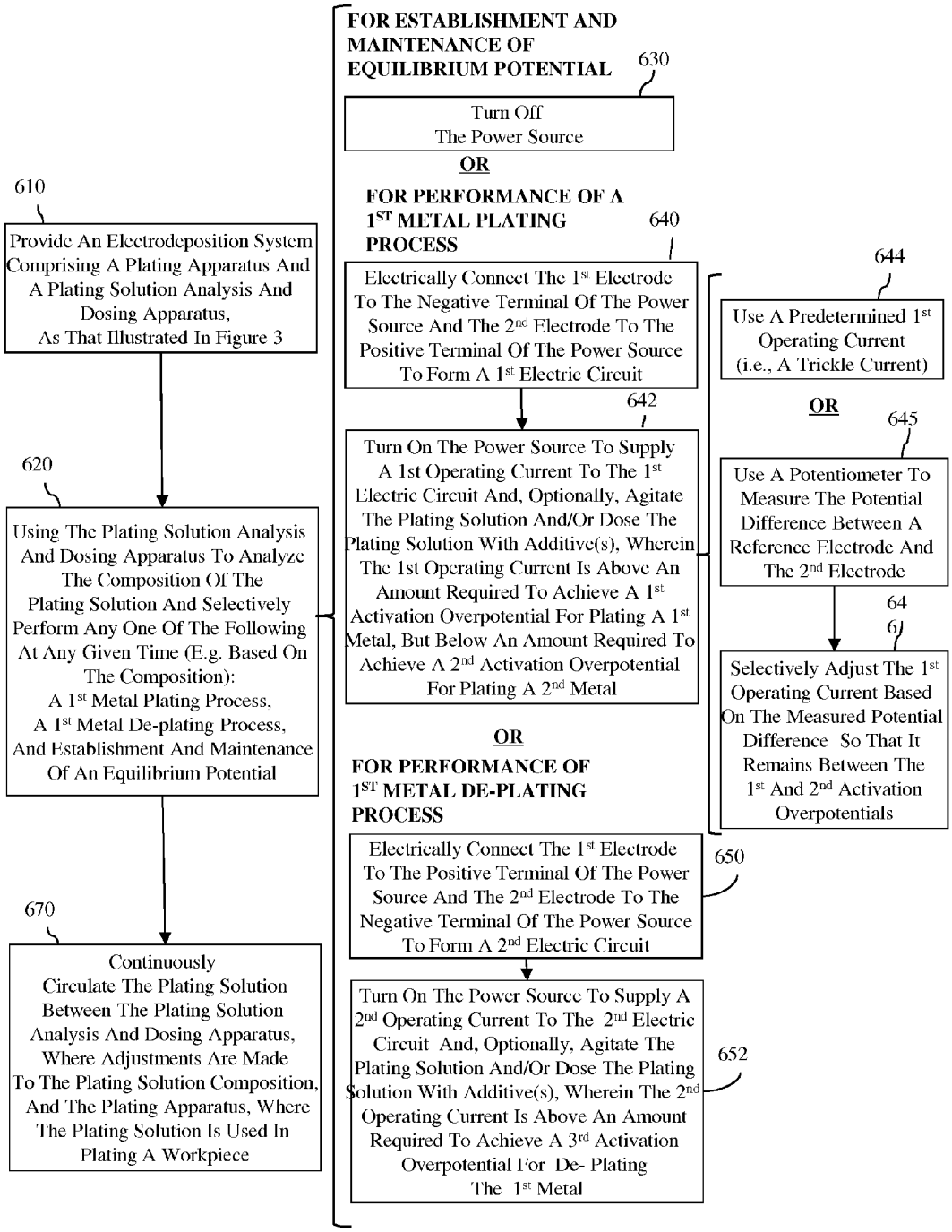
FIG. 6 is a flow diagram illustrating an electrodeposition method that uses a plating solution analysis and dosing apparatus for the selective removal of a specific metal from a multi-metal plating solution and for addition of that specific metal back into the multi-metal plating solution; and, FIG. 7 is a schematic diagram illustrating a representative hardware environment that can be used to implement the disclosed apparatuses, systems, and methods.

Thus, for example, referring to the flow diagram of FIG. 6 in combination with the electrodeposition system 300 of FIG. 3, also disclosed herein is an electrodeposition method that uses a plating solution analysis and dosing apparatus 332 for the selective removal of a specific metal from a multi-metal plating solution 302 as well as for replenishment of that specific metal back into the plating solution 302, as needed.

Specifically, this method can comprise providing an electrodeposition system, such as the electrodeposition system 300 of FIG. 3 (602). As discussed in detail above with regard to the disclosed structures, this electrodeposition system 300 can comprise a plating apparatus 331 and a plating solution analysis and dosing apparatus 332. A pair of tubes (referred to herein as slipstream tubes), including a first tube 333 and a second tube 334, can provide a continuous path for the transport of plating solution 302 from the plating apparatus 331 to a container 301 (i.e., a reservoir, tub, etc.) in the plating solution analysis and dosing apparatus 332 for processing and, following such processing, back to the plating apparatus 331. Thus, within the electrodeposition system 300, the plating solution 302 can continuously circulate between the plating apparatus 331 and the plating solution analysis and dosing apparatus 332.

The plating solution 302 can comprise at least a solvent (e.g., water) and a substance (e.g., an acid or base) that is dissolved in the solvent and that provides ionic conductivity. The plating solution 302 can comprise one or more organic additive(s) (also referred to herein as organics), such as complexers, charge carriers, levelers, brighteners and/or wetters, dissolved in the solvent. The plating solution 302 can also contain multiple different metals including at least a first metal and a second metal different from the first metal. That is, the plating solution 302 can comprise at least positively charged first ions of a first metal 303 (i.e., first metal cations) and positively charged second ions of a second metal 304 different from the first metal (i.e., second metal cations). The first metal 303 can comprise a noble metal (e.g., gold (Au), platinum (Pt), iridium (Ir), palladium (Pd), osmium (Os), silver (Ag), nickel (Ni), cobalt (Co), rhodium (Rh), ruthenium (Ru), etc.). The second metal 304 can comprise a less noble metal than the first metal 303 or a non-noble metal. Those skilled in the art will recognize that the term "noble" refers to the activation overpotential needed for plating. Thus, the term is relative with some metals being more noble than others (i.e., having a lower activation overpotential than others and, thereby being easier to plate then others). So, in this case, the second metal 304 can have a relatively high activation overpotential for plating in the plating solution 302 as compared to the first metal 303. That is, the first metal 303 can have a first activation overpotential for plating in the plating solution 302 and the second metal 304 can have a second activation overpotential for plating in the plating solution 302, wherein the second activation overpotential is higher than the first activation over potential.

Those skilled in the art will recognize that the term "activation overpotential" refers to the state when the potential difference of the active electrode is sufficient to cause plating of a specific metal on the negatively charged electrode or de-plating from the positively charged electrode. It should be understood that the first and second activation overpotentials will depend upon a variety of factors including, but not limited to, the specific type of first metal and second metal used, the composition of the specific plating solution used, the volume of the plating solution used, and the spacing between the first and second electrodes. These activation overpotentials can further be determined using a systematic approach. That is, plating processes be performed using progressively increasing current amounts and following each plating process the plating solution can be analyzed until the range between the first activation overpotential (wherein the first metal plates so that the first concentration of the first metal is reduced) and the second activation overpotential (wherein both the first metal and the second metal plate so that the first concentration of the first metal and the second concentration of the second metal are both reduced) is determined. The term "equilibrium potential" refers to potential of the electrode relative to a standard hydrogen electrode that is in contact with the plating solution.

For example, the plating solution 302 can comprise a MSA-based plating solution used by the plating apparatus 331 during deposition of an SnAg layer, as described in detail above, comprising both Ag+ ions, which are of a noble metal, and $Sn^{2+}$ ions, which are of a non-noble metal and which have a higher overpotential in the plating solution than the Ag+ ions. It should be understood that the reference to a SnAg plating solution is not intended to be limiting and, alternatively, the method could be performed using any plating solution comprising ions of at least two different metals having the properties discussed above.

As mentioned above, the plating solution analysis and dosing apparatus 332 can comprise a container 301. This container 301 can have a first compartment 306 and a second compartment 307 separated from the first compartment 306 by a membrane 309. The first compartment 306 can contain plating solution 302 and can comprise an inlet 336 for receiving the plating solution 302 from the plating apparatus 331 via the first tube 333 and an outlet 337 for outputting the plating solution 302 back to the plating apparatus 331 following processing via the second tube 334. The second compartment 307 can contain an additional solution 305. This additional solution 305 can comprise the same solvent (e.g., water) as the plating solution 302 with the same substance (i.e., the same acid, such as MSA, or base) dissolved therein for providing ionic conductivity. However, this additional solution 305 can be devoid of the metals (i.e., devoid of the first ions of the first metal 303 and of the second ions of the second metal 304) and also devoid of any organic additives. Furthermore, the membrane 309 separating the first compartment 306 and the second compartment 307 can allow the solvent and current to pass, but can be impermeable to the metal ions and the organic additive(s) so that during processing either to remove or add metal to the plating solution 302 within the first compartment 306, as described in detail below, the additional solution 305 in the second compartment 307 does not become contaminated.

The plating solution analysis and dosing apparatus 332 can further comprise a plurality of electrodes 311-313 comprising a first electrode 311 and, optionally, a reference electrode 313 in the plating solution 302 in the first compartment 306 and a second electrode 312 in the additional solution 305 in the second compartment 307. The electrodes 311-313 can all be insoluble electrodes and, preferably, corrosion-resistant electrodes (also referred to herein as inert electrodes). With, for example, MSA-based, plating solution used by the plating apparatus 331 for deposition of a SnAg layer, as described above, an insoluble electrode can refer to, for example, a platinum (Pt) catalyst-coated titanium (Ti) electrode because Ti, when exposed to the MSA-based plating solution is insoluble in a polarized state (i.e., can not be dissolved in) in that MSA-based solution, but may still be subject to corrosion by the plating solution in an unpolarized state; and a corrosion-resistant electrode can refer, for example, to an Alkaline earth metal electrode (e.g., a Vanadium (V) electrode, a niobium (Nb) electrode or Tantalum (Ta) electrode) or an austenitic-type stainless steel electrode because Alkaline earth metals, such as V, Nb and Ta, as well as austenitic-type stainless steel are not only insoluble in the MSA-based plating solution, but also resistant to corrosion by that MSA-based solution. Additionally, each electrode and, particularly, at least the first electrode 311 can have a relatively large surface area (e.g., greater than 40 square inches, greater than 100 square inches, etc.) and can comprise a conductive sheet. The conductive sheet can be a conductive solid sheet (e.g., a conductive plate). For example, the conductive sheet can comprise a sheet wafer with a relatively large diameter (e.g., a 200 mm-diameter sheet wafer with a surface area of approximately 48 square inches, 300 mm-diameter sheet wafer with a surface area of approximately 110 square inches, etc.). Alternatively, the conductive sheet can comprise a conductive mesh sheet with similar dimensions, which may provide an even greater surface area for deposition as well as better adhesion.

The plating solution analysis and dosing apparatus 332 can further comprise a power source 350, a polarity-switching unit 370 and a controller 390 operably connected to the power source 350 and the polarity-switching unit 370. The power source 350 can comprise a negative terminal 351 and a positive terminal 352. The plating polarity-switching unit 370 can be electrically connected to the first electrode 311, the second electrode 312, the negative terminal 351 of the power source 350 and the positive terminal 352 of the power source 350.

The method can further comprise using the plating solution analysis and dosing apparatus 332 to selectively perform any one of the following at any given time: a first metal plating process to decrease a first concentration of the first metal 303 within the plating solution 302 without also decreasing a second concentration of the second metal 304; a first metal de-plating process to increase the first concentration of the first metal 303 within the plating solution 302; and establishment and maintenance of an equilibrium potential so that the first concentration of the first metal 303 and the second concentration of the second metal 304 both remain constant (604). In order to selectively perform any of the above mentioned processes, the method can comprise outputting (e.g., by the controller 390) at least one power control signal 355 to the power source 350 and a polarity control signal 375 to the polarity-switching unit 370. The power control signal(s) 355 can cause the power source 350 to turn on or off and can, optionally, provide for the selective adjustment of the output power level from the power source 350. The polarity control signal 375 can cause the polarity-switching unit 370 to selectively switch electrical connections between the negative and positive terminals 351-352 and the first and second electrodes 311-312.

More specifically, in order to selectively establish and maintain an equilibrium potential, the method can comprise turning off the power source 350 (630). Turning off the power source 350 ensures that neither the first electrode 311, nor the second electrode 312, is polarized and, thus, ensures that no metal plating or metal de-plating occurs in the container 301. Thus, within the plating solution 302, the first concentration of the first metal 303 and the second concentration of the second metal 304 both remain constant.

In order to selectively perform the first metal plating process, the method can comprise causing the polarity-switching unit 370 to electrically connect the first electrode 311 to the negative terminal 351 of the power source 350 and the second electrode 312 to the positive terminal 352 of the power source 350 so as to form a first electric circuit, wherein the first and second electrodes are electrically connected by the plating solution 302 and additional solution 305 (340). The method can further comprise turning on the power source 350 so as to supply a first operating current to the first electric circuit and, optionally, agitating the solutions 302 and 305 (e.g., using agitator(s) 360) (342). This first operating current can specifically be an electric current between a first current amount sufficient to achieve a first activation overpotential for plating of the first metal 303 on the first electrode 311 and a second current amount sufficient to achieve a second activation overpotential for plating of the second metal 304 on the first electrode 311. That is, the controller 390 can ensure that the first operating current supplied by the power source 350 to the first electric circuit (via the polarity-switching unit 370) during the performance of the first metal plating process is high enough so that the first activation overpotential for plating the first metal 303 in a plated layer 315 on the first electrode 311 is achieved, but not so high that the second activation overpotential for plating the second metal 304 is achieved. Thus, only the first metal 303 (i.e., not the second metal 304) plates (see plated layer 315) on the first electrode 311 during the first metal plating process, thereby ensuring that only the first concentration of the first metal 303 is decreased within the plating solution 302 and not the second concentration of the second metal 304. For example, in a container 301 having a first compartment 306 holding approximately 140 L of MSA-based plating solution 302 used for the deposition of an SnAg layer, as described above and, within the plating solution 302, a first electrode 311 comprising a wafer that has a 294 mm diameter and further having a second compartment 307 holding an equal or lesser amount of an additional solution 305, as described above and, within the additional solution 305, a second electrode 312 comprising another wafer that has a 300 mm diameter and that is separated from the first electrode 311 by a spacing of approximately 4 inches, a first operating current of approximately 0.2 amps can be supplied by the power source 350 to the first electric circuit so that a first activation overpotential for plating Ag is achieved without also achieving the second activation overpotential for plating Sn. Thus, only the Ag (i.e., not Sn) plates on the first electrode 311 during the first metal plating process, thereby causing the first concentration of Ag within the plating solution to decrease and the second concentration of the Sn within the plating solution to remain constant.

In order to perform the first metal de-plating process, the method can comprise causing the polarity-switching unit 370 to electrically connect the first electrode 311 to the positive terminal 352 of the power source 350 and the second electrode 312 to the negative terminal 351 of the power source 350 so as to form a second electric circuit, wherein the first and second electrodes are electrically connected by the plating solution 302 and additional solution 305 (350). The method can further comprise turning on the power source 350 so as to supply a second operating current to the second electric circuit and, optionally, agitating the solutions 302 and 305 (e.g., using agitator(s) 360) (352). The second operating current can be yet another current amount sufficient to achieve a third activation overpotential for de-plating the first metal 303 from the first electrode 311 (i.e., so that the first concentration of the first metal 303 is increased within the plating solution 302).

It should be noted that, during the first metal plating process 640-642, the operating current used can be a predetermined current amount between the first current amount and the second current amount and the power source 150 can be set so as to constantly supply this predetermined current amount (e.g., in a trickle current) to the first electric circuit (644). Alternatively, during the first metal plating process 640-642, a potential difference between a reference electrode 313, which is in the plating solution 302 and electrically connected to the negative terminal 351 of the power source 350, and the second electrode 312 can be measured (e.g., using a potentiometer 165) (645). In this case, the operating current supplied by the power source 350 to the electric circuit at process 642 can be selectively adjusted so that this measured potential difference remains between the first activation overpotential and the second activation overpotential, thereby ensuring that only the first metal 303 plates on the first electrode 311 (646).

It should also be noted that the method can further comprise using the plating solution analysis and dosing apparatus 332 to analyze the plating solution 302 in order to determine which of the processes (i.e., the first metal plating process, the first metal de-plating process or the establishment and maintenance of an equilibrium potential) to selectively perform at process 620 as well as to determine whether or not the plating solution 302 should be dosed with any additives during these processes. Specifically, the plating solution analysis and dosing apparatus 332 can further comprise a plating solution analyzer 391, which can be used in determining the composition of the plating solution 302 in the first compartment 306 and, particularly, in determining the concentration of one or more of the components of the plating solution 302 (e.g., the concentration of the first metal 303, the concentration of the second metal 304, and/or the concentration of any organic additives). In any case, based on this composition, the performance of the first metal plating process can be selectively performed (e.g., if the concentration of the first metal 303 in the plating solution 302 should be reduced), the performance of the first metal de-plating process can be selectively performed (i.e., if the concentration of the first metal 303 in the plating solution 302 should be increased) or the equilibrium potential can be established and maintained (e.g., if the correct ratio of the first metal 303 to the second metal 304 has been reached). For example, the amount of first metal 303 dissolved into the plating solution 302 during a first metal de-plating process can be measured (e.g., by a coulometric measurement device of the plating solution analyzer 391) and, when the desired amount has been dissolved, the first metal de-plating process can be stopped and the equilibrium potential can be established and maintained.

Additionally, the plating solution analysis and dosing apparatus 332 can further comprise doser 392, which can be used to add at least one additive to the plating solution 302 during either the first metal plating process or the first metal de-plating process. The additive can comprise, for example, a salt of the second metal (e.g., if the concentration of the second metal 304 in the plating solution 302 should be increased) or one or more organic additive(s) (e.g., if the concentration of any of the organic additives need to be increased), as necessary. For example, during a first metal de-plating process, as the first metal 303 is dissolved back into the plating solution 302 over a given amount of time, a complexer can be added into the plating solution 302 by the doser 392 and the amount added can be metered over time so that the ratio of the first metal 303 to complexer within the plating solution 302 remains essentially constant. Those skilled in the art will recognize that any additive added to the plating solution 302 by the doser 392 should be metered in over time and the rate of addition should take into consideration the flow rate out the outlet 337 and through the tube 334 into the plating apparatus 331 in order to avoid plating solution destabilization within the plating apparatus 331.

The method can further comprise continuously circulating the plating solution 302 through the slipstream tube 333 and inlet 336 into the first compartment 306 of the container 301 and back through the outlet 337 and the slipstream tube 334 into the plating apparatus 331 (670). While in the first compartment 306 of the container 301 of the plating solution analysis and dosing apparatus 332, the plating solution 302 can be processed to adjust its composition, as discussed in detail above. That is, the plating solution 302 can be processed to increase, decrease or maintain the concentration of the first metal 303 contained therein as well as to increase the concentration of other additives, such as a salt of the second metal 304 and/or any organic additives, as necessary. While in the plating apparatus 331, this same plating solution 302 can be used to plate a workpiece (not shown). By providing continuous analysis of and adjustments to the composition of the plating solution 302 simultaneous with the plating of a workpiece, the electrodeposition method disclosed herein can vary the composition of the resulting plated layer on the workpiece as it is being plated and, thereby provides for greater plating control even at relatively high deposition rates. That is, by providing continuous analysis of and adjustments to the composition of the plating solution simultaneous with the plating of a workpiece, the electrodeposition method disclosed herein allows the plating apparatus 331 to plate a metal alloy (e.g., SnAg) on a workpiece at a relatively high deposition rate and to do so such that the metal alloy deposits with selectively different ratios of a first metal 303 to a second metal 304 (e.g., selectively higher or lower Ag contents) throughout that plating process.

Also disclosed herein is a computer program product. The computer program product can comprise a computer readable storage medium having program instructions embodied therewith (i.e., stored thereon). The program instructions can be executable by a processor (e.g., by a processor of the controller 190 described above and illustrated in FIG. 1 or the controller 390 described above and illustrated in FIG. 3) in order to cause the processor to carry out aspects of the present invention and, particularly, to cause the respective apparatuses 100, 332 to perform the above-described methods.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Figure 7:
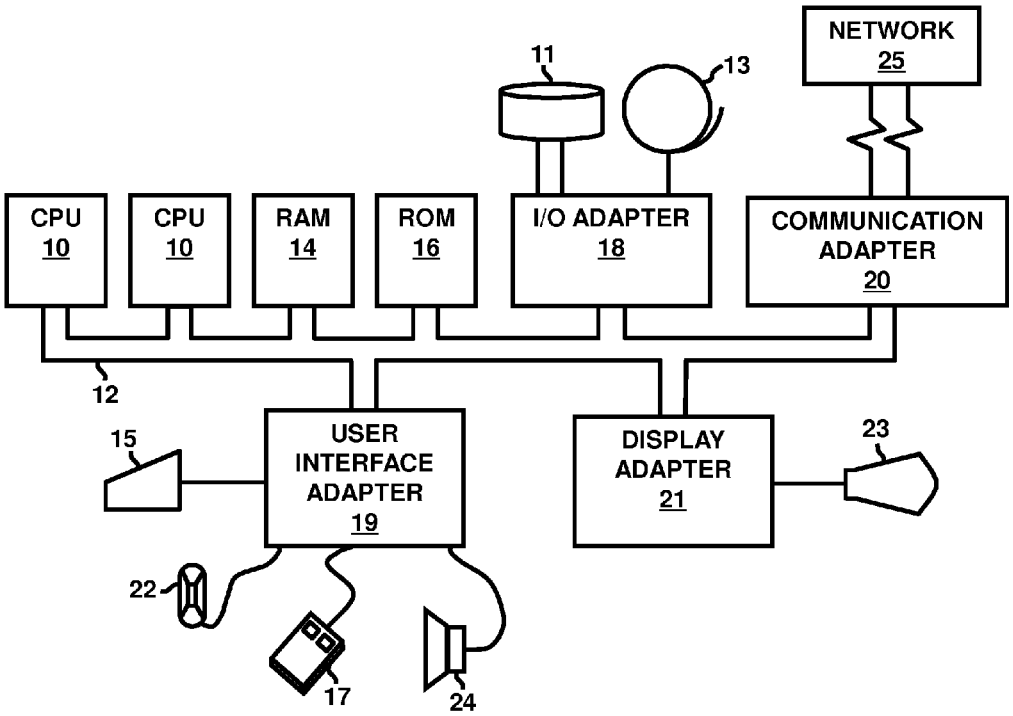

FIG. 7 depicts a representative hardware environment that can be used to implement the above-described apparatuses, systems, methods and computer program products. This schematic drawing illustrates a hardware configuration of an information handling/computer system in accordance with the embodiments herein. The system comprises at least one processor or central processing unit (CPU) 10. The CPUs 10 are interconnected via a system bus 12 to various devices such as a random access memory (RAM) 14, read-only memory (ROM) 16, and an input/output (I/O) adapter 18. The I/O adapter 18 can connect to peripheral devices, such as disk units 11 and tape drives 13, or other program storage devices that are readable by the system. The system can read the inventive instructions on the program storage devices and follow these instructions to execute the methodology of the embodiments herein. The system further includes a user interface adapter 19 that connects a keyboard 15, mouse 17, speaker 24, microphone 22, and/or other user interface devices such as a touch screen device (not shown) to the bus 12 to gather user input. Additionally, a communication adapter 20 connects the bus 12 to a data processing network 25, and a display adapter 21 connects the bus 12 to a display device 23 which may be embodied as an output device such as a monitor, printer, or transmitter, for example.

It should be understood that the terminology used herein is for the purpose of describing the disclosed [systems, methods and computer program products] and is not intended to be limiting. For example, as used herein, the singular forms "a", "an" and "the" are intended to include the plural forms as well, unless the context clearly indicates otherwise. Additionally, as used herein, the terms "comprises" "comprising", "includes" and/or "including" specify the presence of stated features, integers, steps, operations, elements, and/or components, but do not preclude the presence or addition of one or more other features, integers, steps, operations, elements, components, and/or groups thereof. Furthermore, as used herein, terms such as "right", "left", "vertical", "horizontal", "top", "bottom", "upper", "lower", "under", "below", "underlying", "over", "overlying", "parallel", "perpendicular", etc., are intended to describe relative locations as they are oriented and illustrated in the drawings (unless otherwise indicated) and terms such as "touching", "on", "in direct contact", "abutting", "directly adjacent to", etc., are intended to indicate that at least one element physically contacts another element (without other elements separating the described elements). The corresponding structures, materials, acts, and equivalents of all means or step plus function elements in the claims below are intended to include any structure, material, or act for performing the function in combination with other claimed elements as specifically claimed.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Therefore, disclosed above is an apparatus that allows for selective removal of a specific metal from a multi-metal plating solution (i.e., a plating solution containing multiple different metals). In this apparatus, an electric circuit can be established with at least a power source, two electrodes and a plating solution. The plating solution can comprise a solvent and, dissolved in the solvent, at least a first metal and a second metal different from the first metal. An operating current can be supplied by the power source to the electric circuit in order to perform a plating process. This operating current can specifically be between a first current amount sufficient to achieve a first activation overpotential for plating of the first metal and a second current amount sufficient to achieve a second activation overpotential for plating of the second metal such that only the first metal plates (i.e., is removed from the plating solution) during the plating process. This apparatus can be implemented as a discrete metal reclamation apparatus or as either a plating apparatus or a plating solution analysis and dosing apparatus of an electrodeposition system. In the case of a plating solution analysis and dosing apparatus, additional components can optionally be included in the apparatus to allow, not only for the selective removal of the specific metal, as described above, but also for the addition of that specific metal back into the plating solution, as needed. Also disclosed above are associated methods.

What is claimed is:

1. An electrodeposition system comprising:

a plating apparatus; and, a plating solution analysis and dosing apparatus comprising:

a container comprising a membrane separating a first compartment and a second compartment, said first compartment containing a plating solution that circulates between said plating apparatus and said plating solution analysis and dosing apparatus and said second compartment containing an additional solution, said plating solution comprising a solvent and, dissolved in said solvent, a first metal and a second metal different from said first metal, said additional solution comprising said solvent and being devoid of said first metal and said second metal, a first electrode in said plating solution;

a second electrode in said additional solution;

a power source having a negative terminal and a positive terminal;

a polarity-switching unit electrically connected to said negative terminal, said positive terminal, said first electrode, and said second electrode; and a controller operatively connected to said power source and said polarity-switching unit and controlling said power source and said polarity-switching unit so as to selectively cause any one of the following within said plating solution analysis and dosing apparatus: performance of a first metal plating process; performance of a first metal de-plating process; and establishment and maintenance of an equilibrium potential, said controller causing said power source to turn off in order to establish and maintain said equilibrium potential, said controller causing said polarity-switching unit to electrically connect said first electrode to said negative terminal and said second electrode to said positive terminal so as to form a first electric circuit and further causing said power source to turn on and supply a first operating current to said first electric circuit in order to perform said first metal plating process, said first operating current causing said first metal to plate on said first electrode such that a first concentration of said first metal in said plating solution is decreased and such that a second concentration of said second metal in said plating solution remains constant, and said controller causing said polarity-switching unit to electrically connect said first electrode to said positive terminal and said second electrode to said negative terminal so as to form a second electric circuit and further causing said power source to turn on and supply a second operating current to said second electric circuit in order to perform said first metal de-plating process, said second operating current causing said first metal to de-plate from said first electrode such that said first concentration of said first metal in said plating solution is increased.

2. The system of claim 1, said first operating current being a predetermined current amount between a first current amount required to achieve a first activation overpotential for plating said first metal on said first electrode and a second current amount required to achieve a second activation overpotential for plating said second metal on said first electrode, and said second operating current being sufficient to achieve a third activation overpotential for de-plating said first metal from said first electrode.

3. The system of claim 2, further comprising:

a reference electrode in said plating solution and electrically connected to said negative terminal; and a potentiometer electrically connected to said reference electrode and said second electrode, said controller operably connected to said potentiometer and said power source, said potentiometer measuring a potential difference between said reference electrode and said second electrode during said performance of said first metal plating process, and said controller selectively adjusting said first operating current so that said potential difference remains between said first activation overpotential and said second activation overpotential.

4. The system of claim 1, further comprising at least one agitator agitating said plating solution and said additional solution during both said performance of said first metal plating process and said performance of said first metal de-plating process.

5. The system of claim 1, said first electrode comprising a conductive sheet comprising any one of a solid sheet and a mesh sheet.

6. The system of claim 1, said first metal being silver and said second metal being tin.

7. The system of claim 1, further comprising a plating solution analyzer in communication with said controller and determining a composition of said plating solution in said first compartment, said controller selectively causing said one of said performance of said first metal plating process, said performance of said first metal de-plating process and said maintenance of said equilibrium potential, based on said composition.

8. The system of claim 1, further comprising a dosing device adding at least one additive to said plating solution in said first compartment during said performance of said first metal de-plating process.

9. An electrodeposition system comprising:

a plating apparatus; and, a plating solution analysis and dosing apparatus comprising:

a container comprising a membrane separating a first compartment and a second compartment, said first compartment containing a plating solution that circulates between said plating apparatus and said plating solution analysis and dosing apparatus and said second compartment containing an additional solution, said plating solution comprising a solvent and, dissolved in said solvent, a first metal and a second metal different from said first metal, said additional solution comprising said solvent and being devoid of said first metal and said second metal, a first electrode in said plating solution;

a second electrode in said additional solution;

a power source having a negative terminal and a positive terminal;

a polarity-switching unit electrically connected to said negative terminal, said positive terminal, said first electrode, and said second electrode; and a controller operatively connected to said power source and said polarity-switching unit and controlling said power source and said polarity-switching unit so as to selectively cause any one of the following within said plating solution analysis and dosing apparatus: performance of a first metal plating process; performance of a first metal de-plating process; and establishment and maintenance of an equilibrium potential.

10. The system of claim 9, further comprising at least one agitator agitating said plating solution and said additional solution during both said performance of said first metal plating process and said performance of said first metal de-plating process.

11. The system of claim 9, further comprising a plating solution analyzer in communication with said controller and determining a composition of said plating solution in said first compartment, said controller selectively causing said one of said performance of said first metal plating process, said performance of said first metal de-plating process and said maintenance of said equilibrium potential, based on said composition.

* * * * *